US008356970B2

(12) United States Patent
Sugawara et al.

(10) Patent No.: US 8,356,970 B2
(45) Date of Patent: Jan. 22, 2013

(54) EXHAUST PUMP, COMMUNICATING PIPE, AND EXHAUST SYSTEM

(75) Inventors: Eiichi Sugawara, Nirasaki (JP); Tsuyoshi Moriya, Nirasaki (JP)

(73) Assignee: Tokyo Electron Limited, Tokyo (JP)

( * ) Notice: Subject to any disclaimer, the term of this patent is extended or adjusted under 35 U.S.C. 154(b) by 1308 days.

(21) Appl. No.: 12/053,819

(22) Filed: Mar. 24, 2008

(65) Prior Publication Data

US 2008/0240905 A1 Oct. 2, 2008

Related U.S. Application Data

(60) Provisional application No. 60/938,715, filed on May 18, 2007.

(30) Foreign Application Priority Data

Mar. 28, 2007 (JP) ..... 2007-085430

(51) Int. Cl.
*F04D 5/00* (2006.01)
*F04D 19/04* (2006.01)
*F04D 29/70* (2006.01)

(52) U.S. Cl. ..... 415/90; 415/121.2

(58) Field of Classification Search ..... 415/90, 415/121.2; 416/247 R; 417/423.4
See application file for complete search history.

(56) References Cited

U.S. PATENT DOCUMENTS

| | | | | |
|---|---|---|---|---|
| 4,926,648 | A * | 5/1990 | Okumura et al. | 62/55.5 |
| 2002/0126269 | A1* | 9/2002 | Sato | 355/77 |
| 2003/0198741 | A1* | 10/2003 | Uchida et al. | 427/248.1 |
| 2006/0257243 | A1 | 11/2006 | Moriya et al. | |

FOREIGN PATENT DOCUMENTS

| | | | |
|---|---|---|---|
| JP | 61203533 A | * | 9/1986 |
| JP | 01223348 A | * | 9/1989 |
| JP | 02272209 A | * | 11/1990 |
| JP | 07275863 A | * | 10/1995 |
| JP | 8-14188 | | 1/1996 |
| JP | 3120167 | | 3/2006 |
| JP | 2006319328 A | * | 11/2006 |
| JP | 2007046461 A | * | 2/2007 |
| JP | 2007-170225 A | | 7/2007 |

OTHER PUBLICATIONS

Ashida (JP_2007046461) ; Ashida ( JP_2007046461) Abstract Translation; Ashida (JP_2007046461) Machine Translation.*

Tran et al. (JP 2006319328); Tran et al. (JP 2006319328) Abstract Translation; Tran et al. (JP 2006319328) Machine Translation.*

Fukunishi et al. (JP 61203533); Fukunishi et al. (JP 61203533) Abstract Translation.*

(Continued)

*Primary Examiner* — Christopher Verdier
*Assistant Examiner* — Su Htay
(74) *Attorney, Agent, or Firm* — Oblon, Spivak, McClelland, Maier & Neustadt, L.L.P.

(57) ABSTRACT

An exhaust pump that prevents particles from entering a processing chamber of a substrate processing apparatus. The exhaust pump connected to the processing chamber has rotary blades and an air intake portion disposed on the processing chamber side of the rotary blades. A shielding unit is disposed inside the air intake portion and shields the rotary blades when the air intake portion is viewed from the processing chamber side.

15 Claims, 11 Drawing Sheets

OTHER PUBLICATIONS

Hirako (JP_01223348); Hirako (JP_01223348) Abstract Translation.*

Idei et al. (JP 02272209); Idei et al. (JP 02272209) Abstract Translation.*

Togawa (JP 07275863); Togawa (JP 07275863) Abstract Translation.*

Shintaro Sato et al., "Visualization of Backflow Particles from Turbo Molecular Pump" with English Translation, Japan Industrial Publishing Co., Ltd., Clean Technology, Jun. 2003, 18 pages.

Japanese Office Action mailed on Mar. 27, 2012, issued for JP Application No. 2007-085430, filed on Mar. 28, 2007.

* cited by examiner

EXHAUST PUMP, COMMUNICATING PIPE, AND EXHAUST SYSTEM

BACKGROUND OF THE INVENTION

1. Field of the Invention

The present invention relates to an exhaust pump, a communicating pipe, and an exhaust system, and in particular to an exhaust pump, a communicating pipe, and an exhaust system that prevent particles from entering a processing chamber of a substrate processing apparatus.

2. Description of the Related Art

Substrate processing apparatuses that carry out predetermined processing on substrates such as wafers for semiconductor devices have a processing chamber (hereinafter referred to merely as the "chamber") in which a substrate is housed and subjected to predetermined processing. An exhaust system of the substrate processing apparatuses has a turbo-molecular pump (hereinafter referred to as the "TMP"), and a communicating pipe that communicates the TMP and the chamber together. The TMP has a rotary shaft disposed along an exhaust stream, and a plurality of rotary blades projecting out at right angles from the rotary shaft. The rotary blades rotate at high speed about a rotation axis, so that gas in front of the rotary blades is exhausted at high speed to the rear of the rotary blades. The exhaust system exhausts gas from the chamber by operating the TMP.

In the chamber of the substrate processing apparatus, particles arising from deposit attached to an inner wall of the chamber and reaction product produced during predetermined processing are floating. If these floating particles become attached to surfaces of substrates, a short circuit will occur in products such as semiconductor devices manufactured from the substrates, resulting in the yield of the semiconductor devices decreasing.

In recent years, however, it has been found that particles flow back into the chamber from the exhaust system. Specifically, it has been found that deposit attached to the rotary blades of the TMP exfoliates and flows back into the chamber, or particles exhausted from the chamber collide with the rotary blades of the TMP and recoil to directly flow back into the chamber.

It is thought that the deposit exfoliated from the rotary blades and the particles recoiled by the rotary blades are given high kinetic energy by the rotary blades rotating at high speed, and hence they repeat elastic collision with the inner wall of the communicating pipe and enter the chamber irrespective of the presence of an exhaust stream in the communicating pipe.

Regarding the backflow of particles described above, the frequency with which the TMP is replaced is increased so as to prevent particles from arising deposit exfoliated from the rotary blades (see, for example, Sato et al. "Visualization of Particles Flowing Back from Turbo Molecular Pump", Japan Industrial Publishing Co., Ltd., Clean Technology, June 2003, pages 20 to 23).

However, because the collision of the particles and the rotary blades accidentally occur, the particles cannot be prevented from been produced even if the frequency with which the TMP is replaced is increased. As described above, the recoiled particles repeat elastic collision with the inner wall of the communicating pipe to enter the chamber and become attached to surfaces of substrates, resulting in the yield of products manufactured form the substrates decreasing.

SUMMARY OF THE INVENTION

The present invention provides an exhaust pump, a communicating pipe, and an exhaust system that prevent particles from entering a processing chamber.

Accordingly, in a first aspect of the present invention, there is provided an exhaust pump that is connected to a processing chamber of a substrate processing apparatus and has rotary blades and an air intake portion disposed on the processing chamber side of the rotary blades, comprising: a shielding unit that is disposed inside the air intake portion and shields the rotary blades when the air intake portion is viewed from the processing chamber side.

According to the first aspect of the present invention, particles that have been exhausted from the processing chamber and entered the exhaust pump are captured by the shielding unit in the air intake portion. As a result, the particles can be prevented from reaching the rotary blades of the exhaust pump, and hence the particles can be prevented from colliding with the rotary blades and recoiling to directly flow back into the processing chamber. Further, particles that have been produced through exfoliation of deposit attached to the rotary blades of the exhaust pump and to which kinetic energy has been given by the rotary blades are also captured by the shielding unit in the air intake portion. As a result, the particles can be prevented from flowing back into the processing chamber. Thus, the particles can be prevented from entering the processing chamber.

The shielding unit can comprise a plurality of funnel-shaped members and a plate-shaped member disposed on the rotary blade side of the plurality of funnel-shaped members, and each of the plurality of funnel-shaped members can have in a bottom portion thereof an opening facing the plate-shaped member, and the closer the openings of the plurality of funnel-shaped members can be to the plate-shaped member, the smaller the openings of the plurality of funnel-shaped members.

According to the first aspect of the present invention, the rotary blades can be reliably shielded.

Each of the funnel-shaped members and the plate-shaped member can comprise a particle capturing member that captures particles.

According to the first aspect of the present invention, particles can be reliably captured.

Each of the funnel-shaped members and the plate-shaped member can comprise a kinetic energy decreasing member that decreases kinetic energy of particles.

According to the first aspect of the present invention, kinetic energy of particles is decreased. As a result, the particles can be easily captured.

The shielding unit can comprise a plurality of annular members and a plate-shaped member disposed on the rotary blade side of the plurality of annular members, and each of the plurality of annular members can have an opening facing the plate-shaped member, and the closer the openings of the plurality of annular members can be to the plate-shaped member, the smaller the openings of the plurality of annular members.

According to the first aspect of the present invention, the rotary blades can be reliably shielded.

Each of the annular members and the plate-shaped member can comprise a particle capturing member that captures particles.

Each of the annular members and the plate-shaped member can comprise a kinetic energy decreasing member that decreases kinetic energy of particles.

The shielding unit can comprise a laminated structure in which a plurality of angled members are arranged side by side.

According to the first aspect of the present invention, the rotary blades can be reliably shielded.

Each of the angled members can comprise a particle capturing member that captures particles.

Each of the angled members can comprise a kinetic energy decreasing member that decreases kinetic energy of particles.

The shielding unit can comprise a laminated structure in which a plurality of plate-shaped members are arranged side by side, and each of the plate-shaped members can comprise a plurality of holes facing the rotary blades.

According to the first aspect of the present invention, the rotary blades can be reliably shielded.

Each of the plate-shaped members can comprise a particle capturing member that captures particles.

Each of the plate-shaped members can comprise a kinetic energy decreasing member that decreases kinetic energy of particles.

The shielding unit can comprise a funnel-shaped member, a plate-shaped member disposed on the rotary blade side of the funnel-shaped member, and a baffle device comprising a plurality of cylindrical members arranged side by side, and the funnel-shaped member can have in a bottom portion thereof an opening that faces the plate-shaped member.

According to the first aspect of the present invention, the rotary blades can be reliably shielded. Further, particles that have been produced through exfoliation of deposit attached to the rotary blades of the exhaust pump and to which kinetic energy has been given by the rotary blades are baffled in moving directions by the baffle device. As a result, the particles can be made to reliably collide with the funnel-shaped member and the disk-shaped member, and hence the particles can be reliably captured.

Each of the funnel-shaped member, the plate-shaped member, and the cylindrical members can comprise a particle capturing member that captures particles.

Each of the funnel-shaped member, the plate-shaped member, and the cylindrical members can comprise a kinetic energy decreasing member that decreases kinetic energy of particles.

The shielding unit can comprise a filter.

According to the first aspect of the present invention, the rotary blades can be reliably shielded.

The filter can comprise a particle capturing member that captures particles, and the filter can comprise a kinetic energy decreasing member that decreases kinetic energy of particles.

Accordingly, in a second aspect of the present invention, there is provided a communicating pipe that communicates a processing chamber of a substrate processing apparatus and an exhaust pump having rotary blades together, comprising: a shielding unit that is disposed inside the communicating pipe and shields the rotary blades when the communicating pipe is viewed from the processing chamber side.

According to the second aspect of the present invention, particles that have been exhausted from the processing chamber and entered the exhaust pump are captured by the shielding unit in the communicating pipe. As a result, the particles can be prevented from reaching the rotary blades of the exhaust pump, and hence the particles can be prevented from colliding with the rotary blades and recoiling to directly flow back into the processing chamber. Further, particles that have been produced through exfoliation of deposit attached to the rotary blades of the exhaust pump and entered the communicating pipe through kinetic energy given by the rotary blades are also captured by the shielding unit in the communicating pipe. As a result, the particles can be prevented from flowing back into the processing chamber. Thus, the particles can be prevented from entering the processing chamber.

The shielding unit can comprise a plurality of funnel-shaped members and a plate-shaped member disposed on the rotary blade side of the plurality of funnel-shaped members, and each of the plurality of funnel-shaped members can have in a bottom portion thereof an opening that faces the plate-like member, and the closer the openings of the plurality of funnel-shaped members can be to the plate-shaped member, the smaller the openings of the plurality of funnel-shaped members.

According to the second aspect of the present invention, the rotary blades can be reliably shielded.

The shielding unit can comprise a plurality of annular members and a plate-shaped member disposed on the rotary blade side of the plurality of annular members, and each of the plurality of annular members can have an opening that faces the plate-shaped member, and the closer the openings of the plurality of annular members can be to the plate-shaped member, the smaller the openings of the plurality of annular members.

According to the second aspect of the present invention, the rotary blades can be reliably shielded.

The shielding unit can comprise a laminated structure in which a plurality of angled members are arranged side by side.

According to the second aspect of the present invention, the rotary blades can be reliably shielded.

The shielding unit can comprise a laminated structure in which a plurality of plate-shaped members are arranged side by side, and each of the plate-shaped members can comprise a plurality of holes that face the rotary blades.

According to the second aspect of the present invention, the rotary blades can be reliably shielded.

The shielding unit can comprise a funnel-shaped member, a plate-shaped member disposed on the rotary blade side of the funnel-shaped member, and a baffle device comprising a plurality of cylindrical members arranged side by side, and the funnel-shaped member can have in a bottom portion thereof an opening that faces the plate-shaped member.

According to the second aspect of the present invention, the rotary blades can be reliably shielded. Further, particles that have been produced through exfoliation of deposit attached to the rotary blades of the exhaust pump and to which kinetic energy has been given by the rotary blades are baffled in moving directions by the baffle device. As a result, the particles can be made to reliably collide with the funnel-shaped member and the disk-shaped member, and hence the particles can be reliably captured.

The shielding unit can comprise a filter.

According to the second aspect of the present invention, the rotary blades can be reliably shielded.

Accordingly, in a third aspect of the present invention, there is provided an exhaust system that has an exhaust pump, and a communicating pipe that communicates the exhaust pump and a processing chamber of a substrate processing apparatus together, comprising: at least one of an exhaust pump as claimed in claim 1 and a communicating pipe as claimed in claim 20.

According to the third aspect of the present invention, because the exhaust system has at least one of the exhaust pump mentioned above and the communicating pipe mentioned above, any of the above described effects can be obtained.

The above and other objects, features, and advantages of the invention will become more apparent from the following detailed description taken in conjunction with the accompanying drawings.

BRIEF DESCRIPTION OF THE DRAWINGS

FIGS. 2A and 2B are views showing the essential parts of a TMP shown in FIG. 1, in which FIG. 2A is a perspective view schematically showing the construction of a shielding unit provided in the TMP, and FIG. 2B is a sectional view showing how the shielding unit is disposed in the TMP.

FIGS. 3A and 3B are views schematically showing the essential parts of a TMP as an exhaust pump according to a second embodiment of the present invention, in which FIG. 3A is a perspective view schematically showing the construction of a shielding unit provided in the TMP, and FIG. 3B is a sectional view showing how the shielding unit is disposed in the TMP.

FIGS. 4A and 4B are views schematically showing the essential parts of a TMP as an exhaust pump according to a third embodiment of the present invention, in which FIG. 4A is a sectional view schematically showing the construction of a shielding unit provided in the TMP, and FIG. 4B is a sectional view showing how the shielding unit is disposed in the TMP.

FIGS. 5A and 5B are views schematically showing the essential parts of a TMP as an exhaust pump according to a fourth embodiment of the present invention, in which FIG. 5A is a sectional view schematically showing the construction of a shielding unit provided in the TMP, and FIG. 5B is a sectional view showing how the shielding unit is disposed in the TMP.

FIGS. 6A to 6C are views schematically showing the essential parts of a TMP as an exhaust pump according to a fifth embodiment of the present invention, in which FIG. 6A is a perspective view schematically showing the construction of a shielding unit provided in the TMP, FIG. 6B is a sectional view showing how the shielding unit is disposed in the TMP, and FIG. 6C is an enlarged view of a portion C shown in FIG. 6B.

FIGS. 7A and 7B are views schematically showing the essential parts of a TMP as an exhaust pump according to a sixth embodiment of the present invention, in which FIG. 7A is a perspective view schematically showing the construction of a shielding unit provided in the TMP, and FIG. 7B is a sectional view showing how the shielding unit is disposed in the TMP.

FIGS. 9A and 9B are views showing the essential parts of exhaust manifolds as communicating pipes according to the seventh embodiment and an eighth embodiment of the present invention, in which FIG. 9A is a sectional view showing how a shielding unit is disposed in the exhaust manifold as the communicating pipe according to the seventh embodiment of the present invention, and FIG. 9B is a sectional view showing how a shielding unit is disposed in the exhaust manifold as the communicating pipe according to the eighth embodiment of the present invention.

FIGS. 10A and 10B are views showing the essential parts of exhaust manifolds as communicating pipes according to a ninth embodiment and a tenth embodiment of the present invention, in which FIG. 10A is a sectional view showing how a shielding unit is disposed in the exhaust manifold as the communicating pipe according to the ninth embodiment of the present invention, and FIG. 10B is a sectional view showing how a shielding unit is disposed in the exhaust manifold as the communicating pipe according to the tenth embodiment of the present invention.

FIGS. 11A and 11B are views showing the essential parts of exhaust manifolds as communicating pipes according to an eleventh embodiment and a twelfth embodiment of the present invention, in which FIG. 11A is a sectional view showing how a shielding unit is disposed in the exhaust manifold as the communicating pipe according to the eleventh embodiment of the present invention, and FIG. 11B is a sectional view showing how a shielding unit is disposed in the exhaust manifold as the communicating pipe according to the twelfth embodiment of the present invention.

DETAILED DESCRIPTION OF THE PREFERRED EMBODIMENTS

Preferred embodiments of the present invention will now be described in detail with reference to the drawings.

First, a description will be given of a substrate processing apparatus to which an exhaust pump according to a first embodiment of the present invention is applied.

Figure 1:
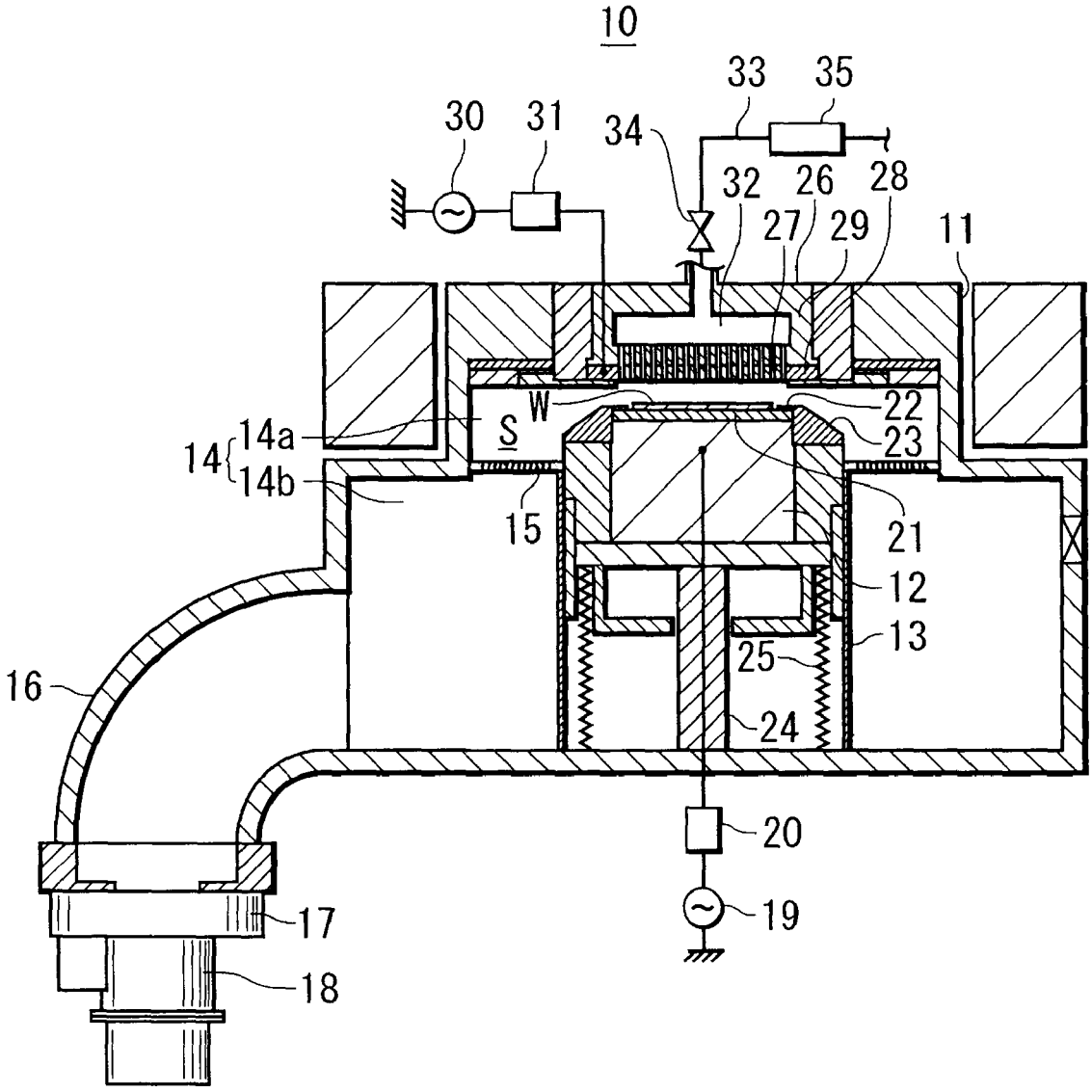
FIG. 1 is a sectional view schematically showing the construction of a substrate processing apparatus to which an exhaust pump according to a first embodiment of the present invention is applied.

FIG. 1 is a sectional view schematically showing the construction of the substrate processing apparatus to which the exhaust pump according to the first embodiment is applied.

As shown in FIG. 1, the substrate processing apparatus 10 is constructed as an etching processing apparatus that carries out reactive ion etching (hereinafter referred to as the "RIE") processing on a wafer W for a semiconductor device (hereinafter referred to merely as a "wafer W"). The substrate processing apparatus 10 has a chamber 11 comprised of two large and small stacked cylinders made of metal such as aluminum or stainless steel.

A lower electrode 12 as a wafer stage on which is mounted a wafer W having a diameter of, for example, 300 mm, and which moves up and down in the chamber 11 together with the mounted wafer W, and a cylindrical cover 13 that covers the side of the lower electrode 12 that moves up and down are disposed in the chamber 11. An exhaust path 14 that acts as a flow path through which gas in the chamber 11 is exhausted from the chamber 11 is formed between an inner side wall of the chamber 11 and the side face of the lower electrode 12 or the cover 13.

An annular exhaust plate 15 that partitions the exhaust path 14 into an upstream side portion 14*a* and a downstream portion 14*b* is disposed part way along the exhaust path 14. The lower side portion 14*b* communicates with a TMP 18, which is an exhaust pump for evacuation, via an exhaust manifold 16 as a communicating pipe and an automatic pressure control valve (adaptive pressure control) (hereinafter referred to as the "APC") valve 17, which is a variable slide valve. It should be noted that the APC valve 17 may be a butterfly valve.

The TMP 18 reduces the pressure in the chamber 11 down to a substantially vacuum state, and the APC valve 17 controls the pressure in the chamber 11 when the pressure in the chamber 11 is reduced. A shielding unit 41 is disposed in an air intake portion 40, described later, of the TMP 18. Here, the exhaust plate 15 has a plurality of circular vent holes that communicate the upstream side portion 14*a* and the downstream side portion 14*b* of the exhaust plate 14 together.

The exhaust path 14, the exhaust plate 15, the exhaust manifold 16, the APC valve 17, and the TMP 18 together constitute an exhaust system.

A lower radio frequency power source 19 is connected to the lower electrode 12 via a lower matcher 20. The lower radio frequency power source 19 applies predetermined radio frequency electrical power to the lower electrode 12. The lower matcher 20 reduces reflection of the radio frequency electrical power from the lower electrode 12 so as to maximize the efficiency of the supply of the radio frequency electrical power into the lower electrode 12.

An ESC 21 for attracting a wafer W through electrostatic attracting force is disposed in an upper portion of the lower electrode 12. A DC power source (not shown) is electrically connected to the ESC 21. The wafer W is attracted to and held on an upper surface of the ESC 21 through a Coulomb force or a Johnsen-Rahbek force produced due to a DC voltage applied from the DC power source to the ESC 21. Moreover, an annular focus ring 22 made of silicon (Si) or the like is provided on a peripheral portion of the ESC 21. The focus ring 22 focuses ions and radicals produced above the lower electrode 12 toward the wafer W. A peripheral portion of the focus ring 22 is covered with an annular cover ring 23.

A support 24 extended downward from a lower portion of the lower electrode 12 is disposed under the lower electrode 12. The support 24 supports the lower electrode 12 and lifts and lowers the lower electrode 12 by turning a ball screw (not shown). Also, a peripheral portion of the support 24 is covered with a bellows cover 25 so as to be cut off from an atmosphere in the chamber 11.

In the substrate processing apparatus 10, when a wafer W is to be transferred into or out from the chamber 11, the lower electrode 12 is lowered to a transfer position for the wafer W, and when the wafer W is to be subjected to the RIE processing, the lower electrode 12 is lifted to a processing position for the wafer W.

A gas introducing shower head 26 that supplies a processing gas, described later, into the chamber 11 is disposed in a ceiling portion of the chamber 11. The gas introducing shower head 26 has a disk-shaped upper electrode (CEL) 28 having therein a number of gas holes 27 facing a processing space S above the lower electrode 12, and an electrode support 29 that is disposed on an upper portion of the upper electrode 28 and on which the upper electrode plate 28 is detachably supported.

An upper radio frequency power source 30 is connected to the upper electrode 28 via an upper matcher 31. The upper radio frequency power source 30 applies predetermined radio frequency electrical power to the upper electrode 28. The upper matcher 31 reduces reflection of the radio frequency electrical power from the upper electrode 28 so as to maximize the efficiency of the supply of the radio frequency electrical power into the upper electrode 28.

A buffer chamber 32 is provided inside the electrode support 29. A processing gas introducing pipe 33 is connected to the buffer chamber 32. A valve 34 is disposed part way along the processing gas introducing pipe 33, and a filter 35 is disposed upstream of the valve 34. A processing gas comprised of, for example, silicon tetrafluoride ($SiF_4$), oxygen gas ($O_2$), argon gas (Ar), and carbon tetrafluoride ($CF_4$) singly or in combination is introduced from the processing gas introducing pipe 33 into the buffer chamber 32, and the introduced processing gas is supplied into the processing space S via the gas vent holes 27.

In the substrate processing chamber 11 of the plasma processing apparatus 10, radio frequency electrical power is applied to the lower electrode 12 and the upper electrode 28, and the processing gas is turned into high-density plasma in the processing space S through the applied radio frequency electrical power, so that positive ions and radicals are produced. The produced radicals and ions are focused onto the front surface of the wafer W by the focus ring 22, whereby the front surface of the wafer W is physically/chemically etched.

Moreover, in the substrate processing apparatus 10, reaction product produced during the etching and floating in the chamber 11, and particles arising from deposit attached to an inner wall of the chamber 11 as well as gas in the chamber 11 are exhausted from the chamber 11 by the exhaust system.

Figure 2A:
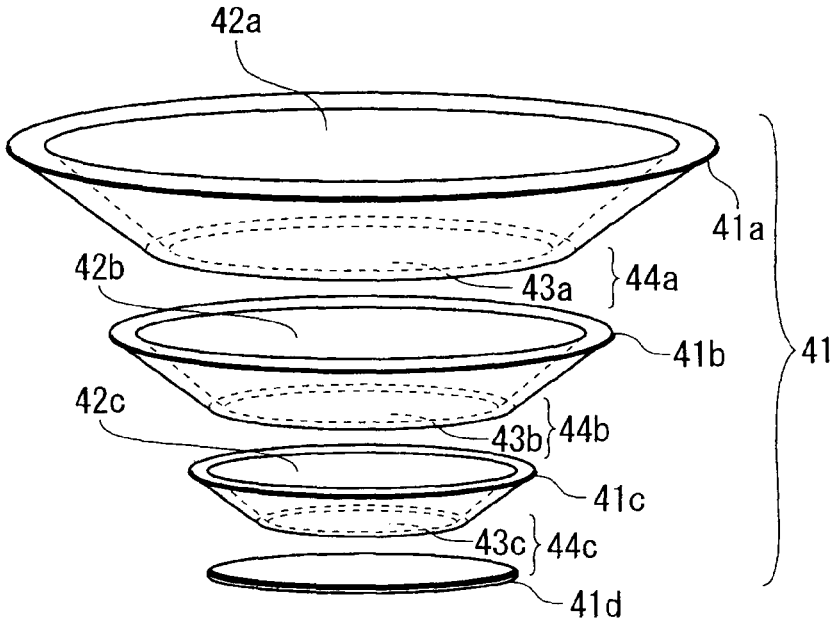
Figure 2B:
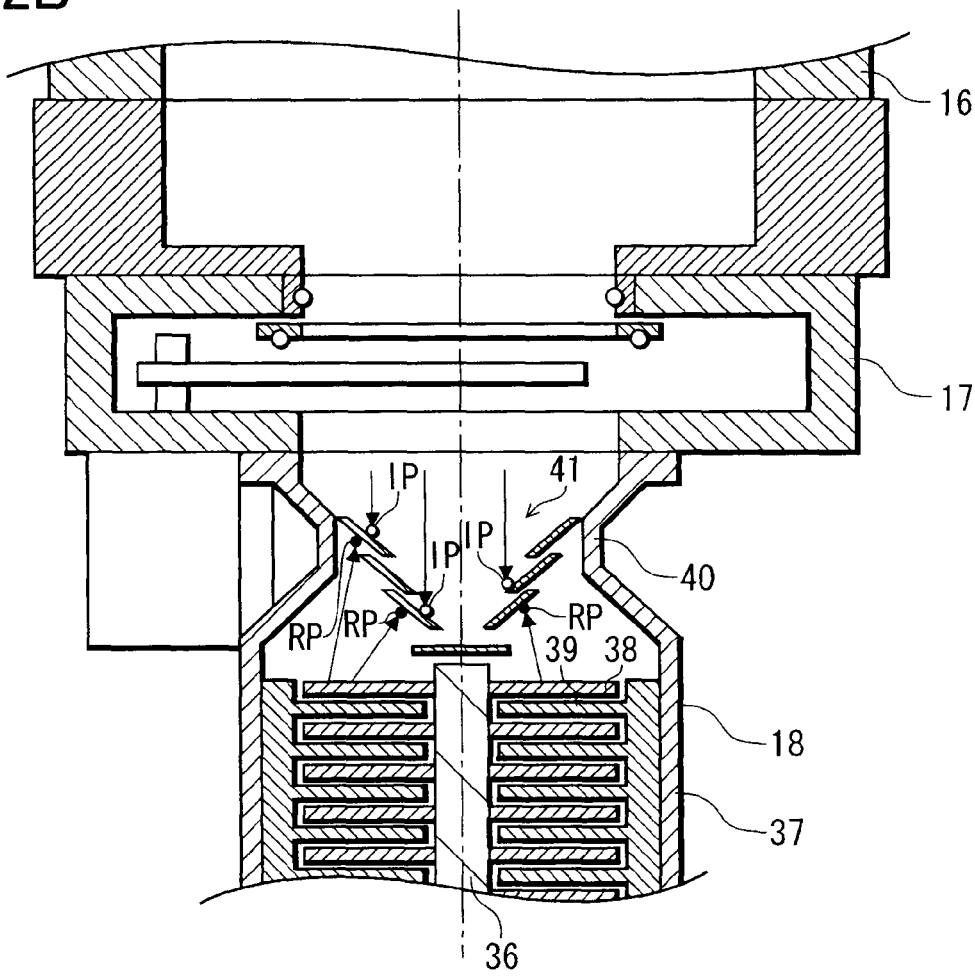

FIGS. 2A and 2B are views showing the essential parts of the TMP shown in FIG. 1, in which FIG. 2A is a perspective view schematically showing the construction of the shielding unit provided in the TMP, and FIG. 2B is a sectional view showing how the shielding unit is disposed in the TMP. It should be noted that an upper portion of FIG. 2B is referred to as the "upper side", and a lower portion of FIG. 2B is referred to as the "lower side."

The TMP 18 has a rotary shaft 36 disposed in a vertical direction as viewed in FIG. 2B, that is, along an exhaust stream, a cylindrical main body 37 disposed parallel to the rotary shaft 36 such as to house the rotary shaft 36, a plurality of rotary blades 38 projecting out at right angles to the rotary shaft 36, and a plurality of stationary blades 39 projecting out from an inner peripheral surface of the main body 37 toward the rotary shaft 36.

The plurality of rotary blades 38 project out radially from the rotary shaft 36 to form a rotary blade group, and the plurality of stationary blades 39 are arranged at regular intervals on the same circumference of the inner peripheral surface of the main body 37 and project out toward the rotary shaft 36 to form a stationary blade group. In the TMP 18, there are a plurality of rotary blade groups and a plurality of stationary blade groups. The rotary blade groups are disposed at regular intervals along the rotary shaft 36, and the stationary blade groups are disposed between the adjacent two rotary blade groups.

The TMP 18 also has the cylindrical air intake portion 40 disposed on the upper side of the cylindrical main body 37, that is, the chamber 11 side of the uppermost rotary blade group, and the shielding unit 41 that is disposed inside the air intake portion 40 and shields the uppermost rotary blade group when the air intake portion 40 is viewed from the chamber 11 side.

As shown in FIG. 2A, the shielding unit 41 is comprised of three funnel-shaped members 41*a* to 41*c* and one disk-shaped member 41*d*, which are disposed in a downward convex form. The funnel-shaped members 41*a* to 41*c* have openings 42*a* to 42*c*, respectively, in top portions thereof and have openings 43*a* to 43*c*, respectively, in bottom portions thereof.

In the air intake portion 40, the funnel-shaped members 41*a* to 41*c* and the disk-shaped member 41*d* are arranged in this order from the upstream side. Moreover, the funnel-shaped members 41*a* to 41*c* and the disk-shaped member 41*d* are arranged such that the centers thereof correspond to the central axis of the rotary shaft 36, and hence the openings 43*a* to 43*c* face the rotary shaft 36 and the disk-shaped member 41*d*. Here, the closer the openings 43*a* to 43*c* are to the disk-shaped member 41*d*, the smaller the inner diameters of the openings 43*a* to 43*c*. The outer diameter of the opening 42*a* is set to be equal to the inner diameter of the air intake portion 40, the inner diameter of the opening 42*b* is set to be greater than the inner diameter of the opening 43*a*, the inner diameter of the opening 42*c* is set to be greater than the inner diameter of the opening 43*b*, and the diameter of the disk-shaped member 41*d* is set to be greater than the inner diameter of the opening 43*c*. Moreover, intervals 44*a* to 44*c* between the funnel-shaped members 41*a* to 41*c* and the disk-shaped member 41*d* are set such that the shielding unit 41 shields the uppermost rotary blade when the air intake portion 40 is viewed form the chamber 11 side, that is, the uppermost rotary blade group cannot be seen when the air intake portion 40 is viewed from every possible angle on the chamber 11 side, and also decrease in the conductance of exhaust is minimized.

The funnel-shaped members 41*a* to 41*c* and the disk-shaped member 41*d* are comprised of, for example, either of a particle capturing mechanism that captures particles, and a kinetic energy decreasing mechanism that captures the particles by decreasing kinetic energy of the particles as listed below:

1) A material in which fibrous substances are intertwined in a random fashion, a material in which fibrous substances are woven in a specific pattern, or a material having a number of small spaces (hereinafter referred to as the "particle capturing material")
2) A flexible material that can absorb shocks caused by collision with particles (hereinafter referred to as the "shock absorbing material")
3) A material to which particles can be adhered (hereinafter referred to as the "adhesive material")
4) A group of small rooms or a group of a plurality of grooves opening to a space into which particles enter or in which particles recoil (hereinafter referred to as the "particle introducing structure")

In the particle capturing material, particles having entered the particle capturing material repeatedly collide with boundary surfaces of fibrous substances or small spaces. Moreover, the flowing paths of the particles extend through the repetition of the collision, and hence friction between the particles and gas molecules increases. Thus, the momentum of the particles can be decreased, whereby the particles can be captured. Furthermore, the kinetic energy of the particles is lost through the repetition of the collision. As a result of this as well, the momentum of the particles can be decreased, so that the particles can be captured.

In the shock absorbing material, because shocks caused by collision with particles are absorbed to reduce the momentum of the particles, the particles can be captured. Moreover, because a structure in which fibrous substances are intertwined in a random fashion, or a structure having a number of small spaces is made of the shock absorbing material, the number of times particles collide with the shock absorption material in the structure can be increased, and hence the momentum of the particles can be reliably decreased.

In the adhesive material, because particles adhere to the adhesive material, the particles can be directly captured.

In the particle introducing structure, because particles introduced into small rooms and grooves are made to repeatedly collide with wall surfaces of the small rooms and the grooves, the momentum of the particles can be decreased. In particular, if the particle introducing structure is provided on a surface of the particle capturing material, shock absorbing material, or adhesive material, the momentum of particles can be decreased before the particles reach the particle capturing material, shock absorbing material, or adhesive material, and hence the particle capturing material, shock absorbing material, or adhesive material can easily capture the particles. Further, the particle capturing material, shock absorbing material, or adhesive material may be provided on surfaces of the small rooms and the grooves.

Moreover, it is preferred that constituent materials of the above described particle capturing material, shock absorbing material, adhesive material, and particle introducing structure are heat-resistant, resistant to corrosion by plasma (resistant to corrosion by radicals and ions), acid-resistant, and have adequate stiffness against an exhaust stream in the exhaust system. Examples of the constituent materials include metal (stainless steel, aluminum, or silicon), ceramics (alumina ($Al_2O_3$)), yttrium oxide ($Y_2O_3$), quartz, organic compound (PI, PBI, PTFE, PTCFE, PEI, or CF-based rubber or silicon-based rubber). Alternatively, a predetermined core material subjected to surface treatment such as oxidation or thermal spraying may be used (yttrium sprayed substance, alumina sprayed substance, or alumite processed substance).

The interior of the air intake portion 40 of the TMP 18 is in an environment at a low pressure of at least not more than 0.133 Pa (1 mTorr). The present inventors ascertained that in an environment at a low pressure of at least not more than 0.133 Pa (1 mTorr), particles do not move according to gas viscous force but move according to gravitational force or inertia force, that is, particles move straight in a fixed direction. Specifically, the present inventors prepared a chamber separately, set the pressure in the chamber to a predetermined pressure, and observed behaviors of particles produced in the chamber, and ascertained that in an environment at a low pressure of at least not more than 0.133 Pa (1 mTorr), the particles do not move according to gas viscous force but move according to gravitational force or inertia force. Thus, in the air intake portion 40 of the TMP 18, particles IP having entered the TMP 18 and particles RP to which kinetic energy has been given by the rotary blades 38 linearly move in a fixed direction.

In the present embodiment, particles IP having entered the TMP 18 move in the vertical direction as viewed in FIG. 2B, that is, along the exhaust stream. In the air intake portion 40 of the TMP 18, the shielding unit 41 is disposed which shields the uppermost rotary blade group when the air intake portion 40 is viewed from the chamber 11 side, that is, the uppermost rotary blade group cannot be seen when the air intake portion 40 is viewed from every possible angle on the chamber 11 side, and hence the particles IP collide with the shielding unit 41 in the air intake portion 40. The members 41*a* to 41*d* constituting the shielding unit 41 are comprised of the particle capturing mechanism or the kinetic energy decreasing mechanism as described above. Thus, the particles IP are captured by the shielding unit 41 in the air intake portion 40. Also, particles RP that have been produced through exfoliation of deposit attached to the rotary blades 38 of the TMP 18 and to which kinetic energy has been given by the rotary blades 38 linearly move upward as shown in FIG. 2B. Thus, the particles RP are also captured by the shielding unit 41 in the air intake portion 40.

According to the present embodiment, in the air intake portion 40 of the TMP 18, the shielding unit 41 is disposed which shields the uppermost rotary blade group when the air intake portion 40 is viewed from the chamber 11 side, that is, the uppermost rotary blade group cannot be seen when the air intake portion 40 is viewed from every possible angle on the chamber 11 side, and hence the particles IP having entered the TMP 18 are captured by the shielding unit 41 in the air intake portion 40. As a result, the particles IP can be prevented from reaching the rotary blades 38 of the TMP 18, and hence the particles IP can be prevented from colliding with the rotary blades 38 and recoiling to directly flow back into the chamber 11. Further, the particles RP that have been produced through exfoliation of deposit attached to the rotary blades 38 of the TMP 18 and to which kinetic energy has been given by the rotary blades 38 are also captured by the shielding unit 41 in the air intake portion 40. As a result, the particles can be prevented from flowing back into the chamber 11. Thus, the particles can be prevented from entering the chamber 11. As a result, the particles can be prevented from becoming attached to wafers W to which the RIE processing is carried out by the substrate processing apparatus 10, resulting in the yield of the wafers W increasing.

Moreover, according to the present embodiment, the shielding unit 41 prevents the particles IP from reaching the rotary blades 38, the particles IP can be prevented from becoming attached to the rotary blades 38, and hence the frequency with which the rotary blades 38 should be cleaned can be decreased.

Further, according to the present embodiment, because the shielding unit 41 can be easily detached from the TMP 18, the cleanness of the interior of the TMP 18 can be easily improved by cleaning the shielding unit 41, and hence the frequency with which the TMP 18 should be cleaned can be decreased.

Further, in the present embodiment, the shielding unit 41 may be held in any manner insofar as the conductance of exhaust is not decreased. For example, the shielding unit 41 may be held by a holding portion extended from the central axis of the rotary blades 38.

Next, a description will be given of an exhaust pump according to a second embodiment of the present invention.

The present embodiment is basically the same as the first embodiment described above in terms of construction and operation, differing from the first embodiment in the construction of the shielding unit. Features of the construction and operation that are the same as in the first embodiment will thus not be described, only features that are different from those of the first embodiment being described below. Also, a substrate processing apparatus to which the exhaust pump according to the present embodiment is applied is basically the same as the substrate processing apparatus to which the exhaust pump according to the first embodiment described above is applied, and therefore description thereof is omitted.

Figure 3A:
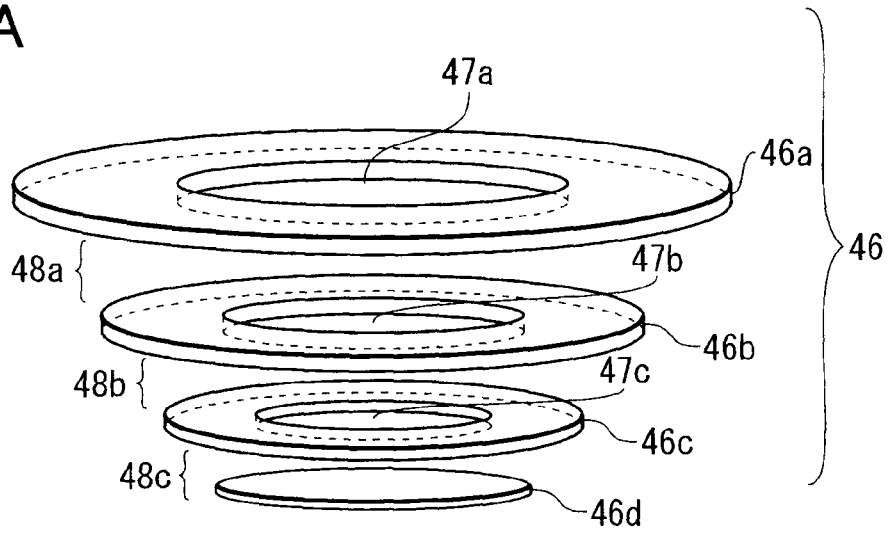
Figure 3B:
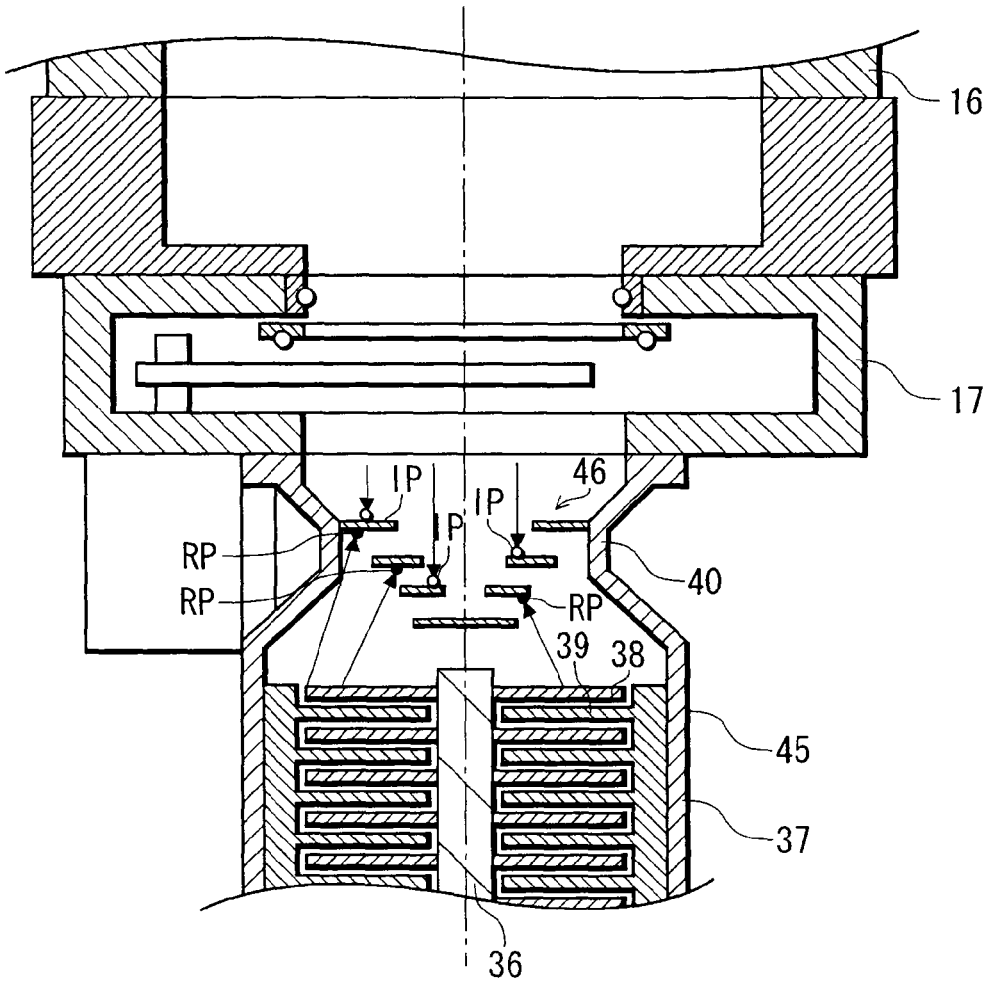

FIGS. 3A and 3B are views showing the essential parts of a TMP as the exhaust pump according to the second embodiment, in which FIG. 3A is a perspective view schematically showing the construction of a shielding unit provided in the TMP, and FIG. 3B is a sectional view showing how the shielding unit is disposed in the TMP.

As shown in FIG. 3B, the TMP 45 has a shielding unit 46 that is disposed in the air intake portion 40 and shields the uppermost rotary blade group when the air intake portion 40 is viewed from the chamber 11 side.

As shown in FIG. 3A, the shielding unit 46 is comprised of three annular members 46*a* to 46*c* and one disk-shaped member 46*d*, which are longitudinally disposed in the air intake portion 40. The annular members 46*a* to 46*c* have openings 47*a* to 47*c*, respectively, in central portions thereof.

In the air intake portion 40, the annular members 46*a* to 46*c* and the disk-shaped member 46*d* are disposed in this order from the upstream side. Moreover, the annular members 46*a* to 46*c* and the disk-shaped member 46*d* are disposed such that the centers thereof correspond to the central axis of the rotary shaft 36, and hence the openings 47*a* to 47*c* face the rotary shaft 36 and the disk-shaped member 46*d*. Here, the closer the openings 43*a* to 43*c* are to the disk-shaped member 46*d*, the smaller the inner diameters of the openings 47*a* to 47*c*. The diameter of the annular member 46*a* is set to be equal to the inner diameter of the intake portion 40, the diameter of the annular member 46*b* is set to be greater than the inner diameter of the opening 47*a*, the diameter of the annular member 46*c* is set to be greater than the inner diameter of the opening 47*b*, and the diameter of the disk-shaped member 46*d* is set to be greater than the inner diameter of the opening 47*c*. Moreover, intervals 48*a* to 48*c* between the annular members 46*a* to 46*c* and the disk-shaped member 46*d* are set such that the shielding unit 46 shields the uppermost rotary blade when the air intake portion 40 is viewed form the chamber 11 side, that is, the uppermost rotary blade group cannot be seen when the air intake portion 40 is viewed from every possible angle on the chamber 11 side, and also decrease in the conductance of exhaust is minimized.

The annular members 46*a* to 46*c* and the disk-shaped member 46*d* are comprised of either of the particle capturing mechanism and the kinetic energy decreasing mechanism described in detail in the above description of the first embodiment.

According to the present embodiment, in the air intake portion 40 of the TMP 45, the shielding unit 46 is disposed which shields the uppermost rotary blade group when the air intake portion 40 is viewed from the chamber 11 side, that is, the uppermost rotary blade group cannot be seen when the air intake portion 40 is viewed from every possible angle on the chamber 11 side, and hence the same effects as those in the first embodiment described above can be obtained.

Next, a description will be given of an exhaust pump according to a third embodiment of the present invention.

The present embodiment is basically the same as the first and second embodiments described above in terms of construction and operation, differing from the first and second embodiments in the construction of the shielding unit. Features of the construction and operation that are the same as in the first and second embodiments will thus not be described, only features that are different from those of the first and second embodiments being described below.

Figure 4A:
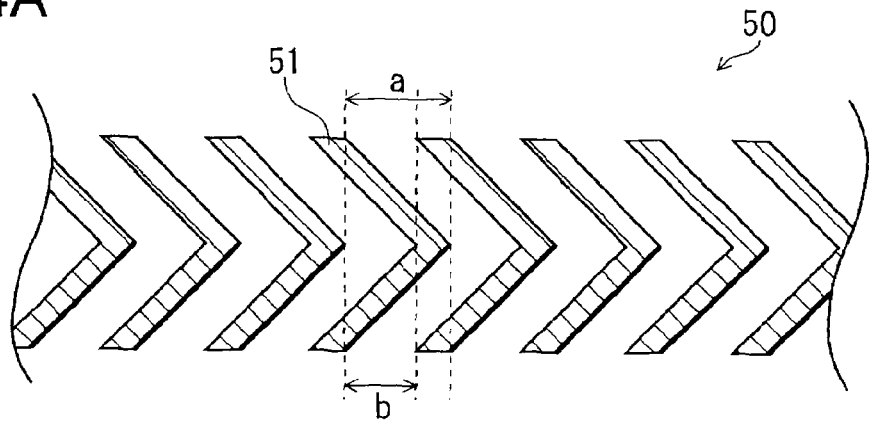
Figure 4B:
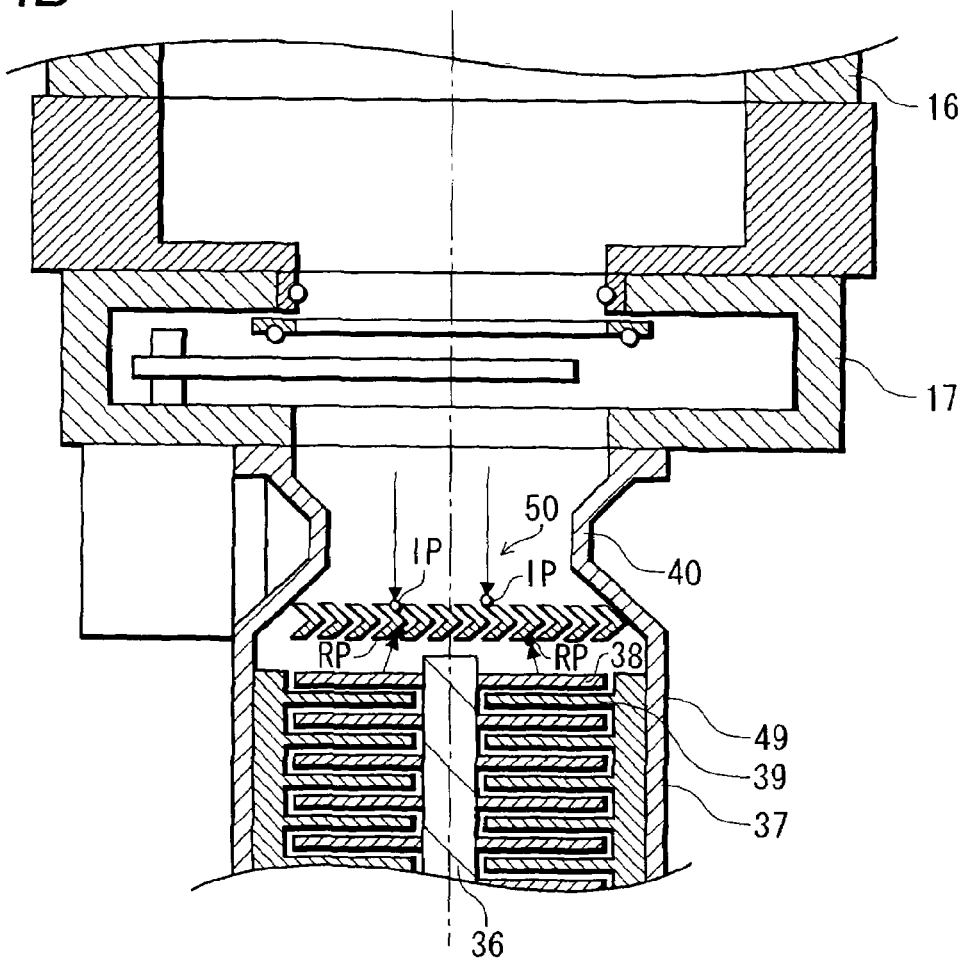

FIGS. 4A and 4B are views showing the essential parts of a TMP as the exhaust pump according to the third embodiment, in which FIG. 4A is a sectional view schematically showing the construction of a shielding unit provided in the TMP, and FIG. 4B is a sectional view showing how the shielding unit is disposed in the TMP.

As shown in FIG. 4B, the TMP 49 has a shielding unit 50 that is disposed in the air intake portion 40 and shields the uppermost rotary blade group when the air intake portion 40 is viewed from the chamber 11 side.

As shown in FIG. 4A, the shielding unit 50 is comprised of a laminated structure in which a plurality of angled members 51 are arranged side by side in a horizontal direction in the air intake portion 40. An interval b between two adjacent angled members 51 is set to be smaller than the height of a convex portion of each angled member 51, and also set such that the conductance of exhaust is not decreased.

The angled members 51 are comprised of either of the particle capturing mechanism and the kinetic energy decreasing mechanism described in detail in the above description of the first embodiment.

According to the present embodiment, in the air intake portion 40 of the TMP 49, the shielding unit 50 is disposed which shields the uppermost rotary blade group when the air intake portion 40 is viewed from the chamber 11 side, that is, the uppermost rotary blade group cannot be seen when the air intake portion 40 is viewed from every possible angle on the chamber 11 side, and hence the same effects as those in the first embodiment described above can be obtained.

Next, a description will be given of an exhaust pump according to a fourth embodiment of the present invention.

The present embodiment is basically the same as the first to third embodiments described above in terms of construction and operation, differing from the first to third embodiments in the construction of the shielding unit. Features of the construction and operation that are the same as in the first to third embodiments will thus not be described, only features that are different from those of the first to third embodiments being described below.

Figure 5A:
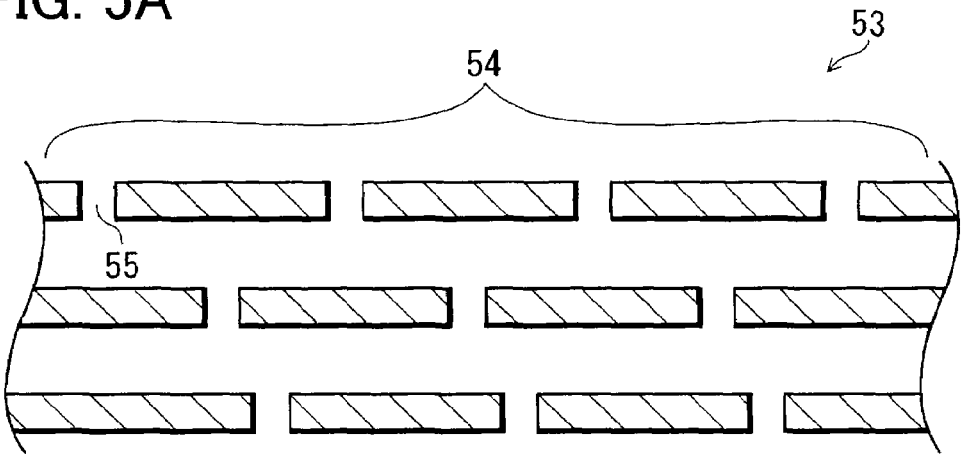
Figure 5B:
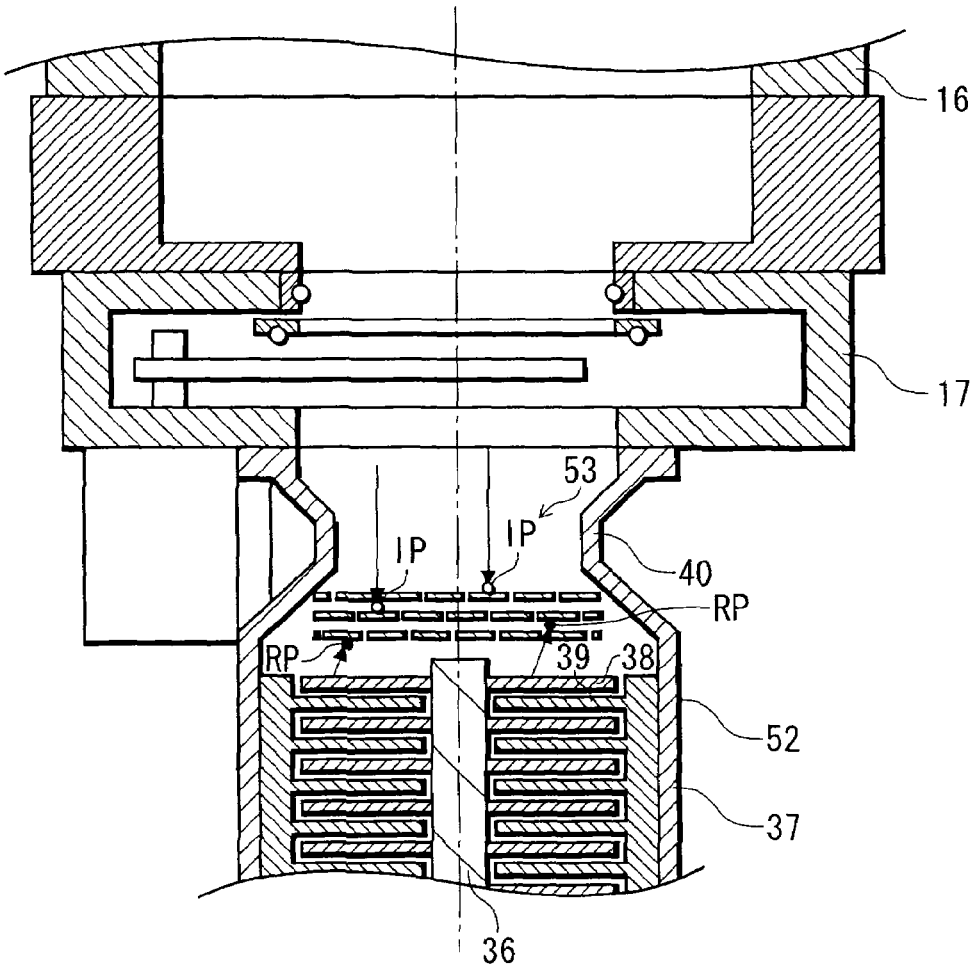

FIGS. 5A and 5B are views showing the essential parts of a TMP as the exhaust pump according to the fourth embodiment, in which FIG. 5A is a sectional view schematically showing the construction of a shielding unit provided in the TMP, and FIG. 5B is a sectional view showing how the shielding unit is disposed in the TMP.

As shown in FIG. 5B, the TMP 52 has a shielding unit 53 that is disposed in the air intake portion 40 and shields the uppermost rotary blade group when the air intake portion 40 is viewed from the chamber 11 side.

As shown in FIG. 5A, the shielding unit 53 is comprised of a laminated structure in which a plurality of flat plate-shaped members 54 are arranged side by side in a vertical direction in the air intake portion 40. Each of the flat plate-shaped members 54 has a plurality of holes 55 that face the rotation axis. The number and diameter of holes 55 of each plate-shaped member 54 are set such that the conductance of exhaust is not decreased.

The plate-shaped members 54 are comprised of either of the particle capturing mechanism and the kinetic energy decreasing mechanism described in detail in the above description of the first embodiment.

According to the present embodiment, in the air intake portion 40 of the TMP 52, the shielding unit 53 is disposed which shields the uppermost rotary blade group when the air intake portion 40 is viewed from the chamber 11 side, that is, the uppermost rotary blade group cannot be seen when the air intake portion 40 is viewed from every possible angle on the chamber 11 side, and hence the same effects as those in the first embodiment described above can be obtained.

Next, a description will be given of an exhaust pump according to a fifth embodiment of the present invention.

The present embodiment is basically the same as the first to fourth embodiments described above in terms of construction and operation, differing from the first to fourth embodiments in the construction of the shielding unit. Features of the construction and operation that are the same as in the first to fourth embodiments will thus not be described, only features that are different from those of the first to fouth embodiments being described below.

Figure 6A:
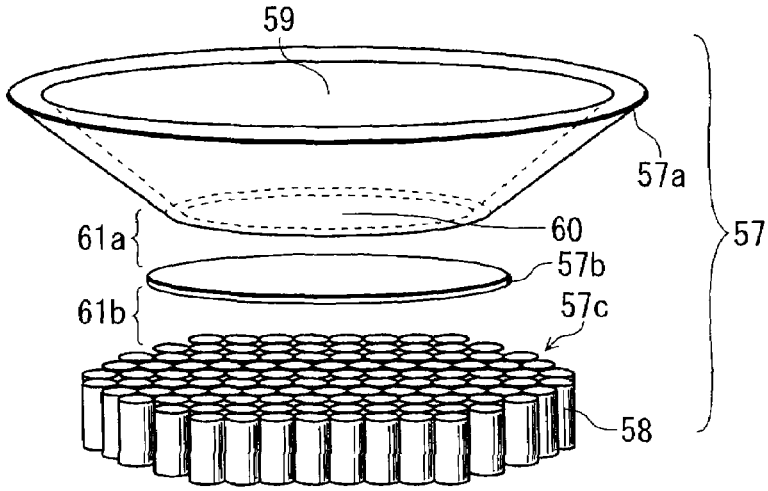
Figure 6B:
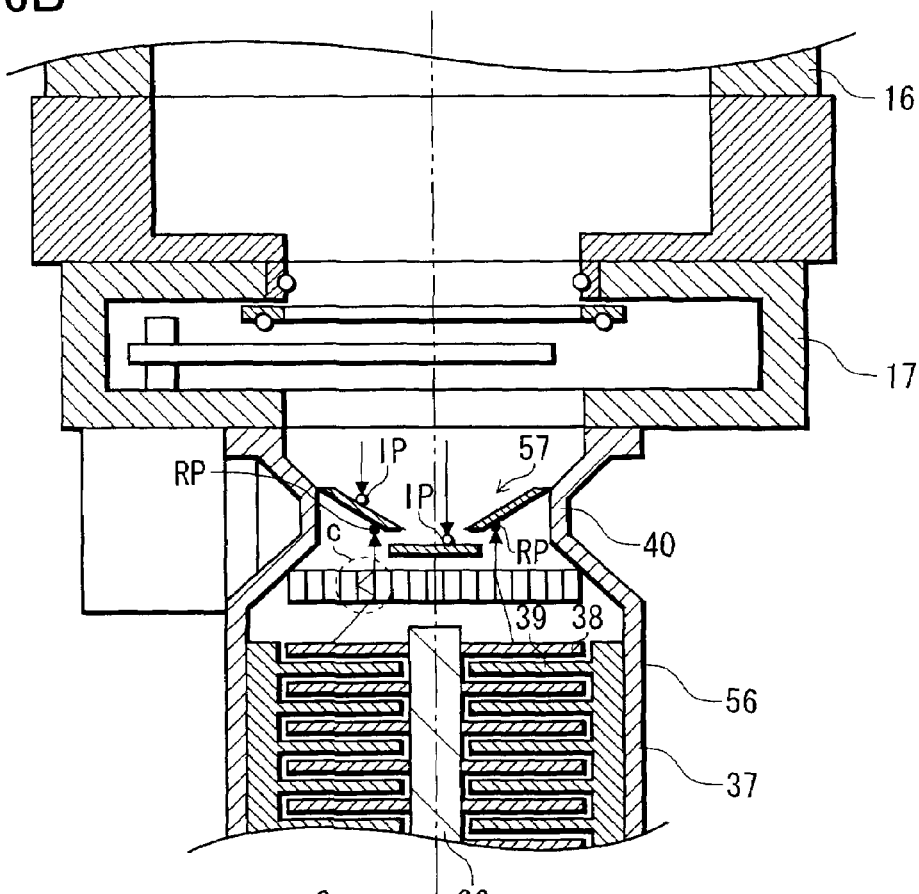
Figure 6C:
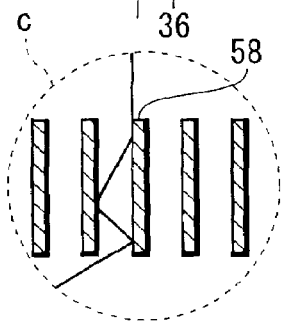

FIGS. 6A to 6C are views showing the essential parts of a TMP as the exhaust pump according to the fifth embodiment, in which FIG. 6A is a perspective view schematically showing the construction of a shielding unit provided in the TMP, FIG. 6B is a sectional view showing how the shielding unit is disposed in the TMP, and FIG. 6C is an enlarged view of a portion C shown in FIG. 6B.

As shown in FIG. 6B, the TMP 56 has a shielding unit 57 that is disposed in the air intake portion 40 and shields the uppermost rotary blade group when the air intake portion 40 is viewed from the chamber 11 side.

As shown in FIG. 6A, the shielding unit 57 is comprised of a laminated structure 57*c* in which one funnel-shaped member 57*a* in a downward convex form, one disk-shaped member 57*b*, and a plurality of cylindrical members 58 are arranged side by side in the air intake portion 40. The funnel-shaped member 57*a* has an opening 59 in a top portion thereof and has an opening 60 in a bottom portion thereof.

In the air intake portion 40, the funnel-shaped member 57*a*, the disk-shaped member 57*b*, and the laminated structure 57*c* are disposed in this order from the upstream side. Moreover, the funnel-shaped member 57*a* and the disk-shaped member 57*b* are disposed such that the centers thereof correspond to the central axis of the rotary shaft 36, and hence the opening 60 faces the rotary shaft 36 and the disk-shaped member 57*b*. Here, the outer diameter of the opening 59 is set to be equal to the inner diameter of the air intake portion 40, and the diameter of the disk-shaped member 57*b* is set to be not less than the inner diameter of the opening 60. Moreover, intervals 61*a* and 61*b* between the funnel-shaped member 57*a*, the disk-shaped member 57*b*, and the laminated structure 57*c* are set such that the shielding unit 57 shields the uppermost rotary blade when the air intake portion 40 is viewed form the chamber 11 side, that is, the uppermost rotary blade group cannot be seen when the air intake portion 40 is viewed from every possible angle on the chamber 11 side, and also the conductance of exhaust is not decreased. The hole diameter and hole length of each cylindrical member 58 are also set such that the conductance of exhaust is not decreased.

The funnel-shaped member 57*a*, the disk-shaped member 57*b*, and the cylindrical members 58 are comprised of either of the particle capturing mechanism and the kinetic energy decreasing mechanism described in detail in the above description of the first embodiment.

In the present embodiment, if the cylindrical members 58 are comprised of the particle capturing mechanism, particles RP to which kinetic energy has been given by the rotary blades 38 repeats inelastic collision with walls of the cylindrical members 58 of the laminated structure 57*c* when passing through the cylindrical members 58 as shown in FIG. 6C. As a result, the momentum of the particles RP in the horizontal direction as viewed in the drawing is absorbed, and all the particles RP having passed through the cylindrical members 58 move in directions against an exhaust stream. The laminated structure 57*c* thus acts as a baffle device that adjusts the moving directions of the particles RP. Therefore, the particles RP reliably collide with the funnel-shaped member 57*a* and the disk-shaped member 57*b*, and as a result, captured by the funnel-shaped member 57*a* and the disk-shaped member 57*b*.

According to the present embodiment, in the air intake portion 40 of the TMP 56, the shielding unit 57 is disposed which shields the uppermost rotary blade group when the air intake portion 40 is viewed from the chamber 11 side, that is, the uppermost rotary blade group cannot be seen when the air intake portion 40 is viewed from every possible angle on the chamber 11 side, and hence the same effects as those in the first embodiment described above can be obtained. It should be noted that the above described rectifier can limit the moving directions of the particles RP, and hence the above described effects can be obtained even if the funnel-shaped member 57*a* and the disk-shaped member 57*b* constituting the shielding unit 57 are not disposed such that the uppermost rotary blade group cannot be seen when the air intake portion 40 is viewed from every possible angle on the chamber 11 side, that is, insofar as the funnel-shaped member 57*a* and the disk-shaped member 57*b* are disposed such that the uppermost rotary blade group cannot be seen when the air intake portion 40 is viewed from the direction along the exhaust stream on the chamber 11 side.

Next, a description will be given of an exhaust pump according to a sixth embodiment of the present invention.

The present embodiment is basically the same as the first to fifth embodiments described above in terms of construction and operation, differing from the first to fifth embodiments in the construction of the shielding unit. Features of the construction and operation that are the same as in the first to fifth embodiments will thus not be described, only features that are different from those of the first to fifth embodiments being described below.

Figure 7A:
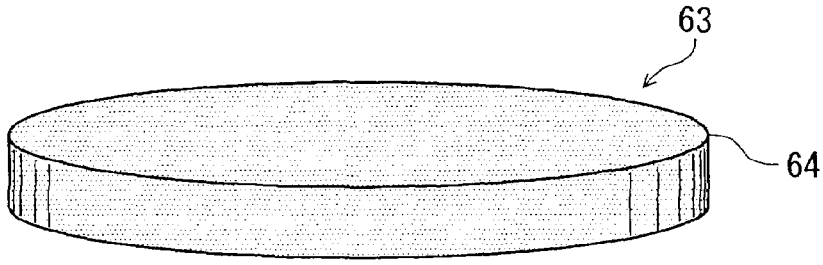
Figure 7B:
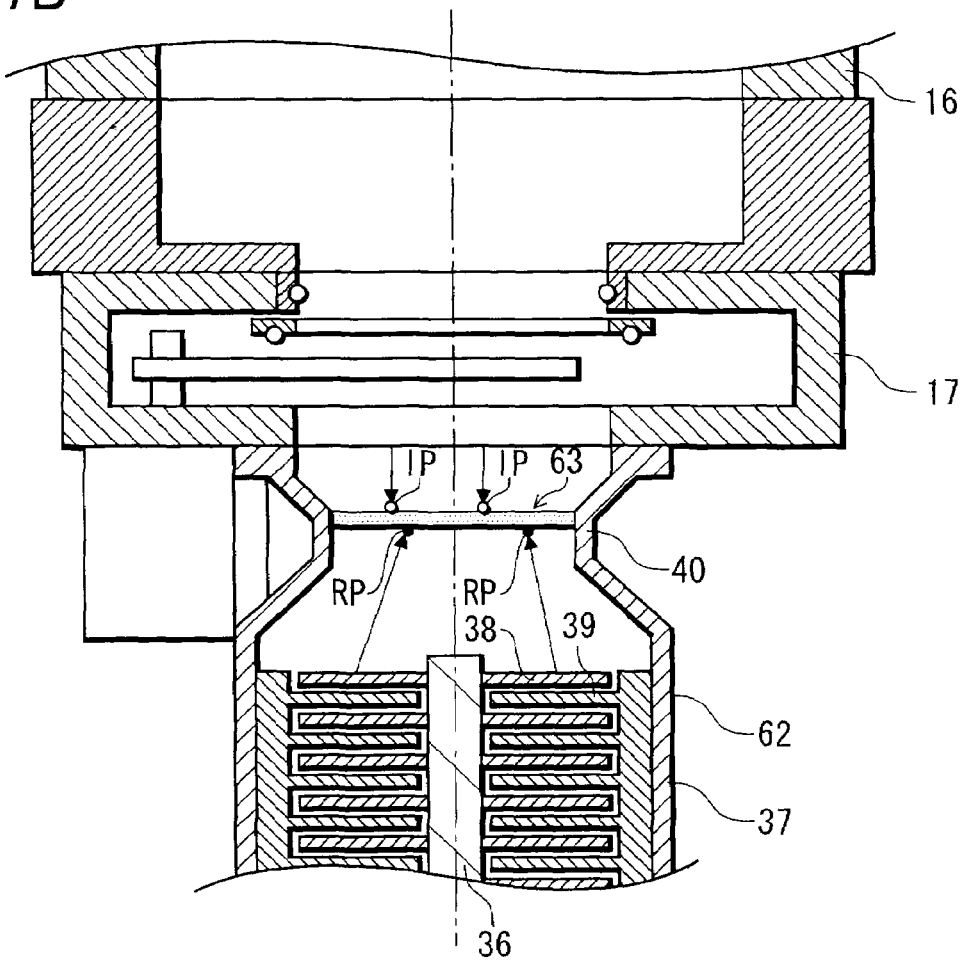

FIGS. 7A and 7B are views showing the essential parts of a TMP as the exhaust pump according to the sixth embodiment, in which FIG. 7A is a perspective view schematically showing the construction of a shielding unit provided in the TMP, and FIG. 7B is a sectional view showing how the shielding unit is disposed in the TMP.

As shown in FIG. 7B, the TMP 62 has a shielding unit 63 that is disposed in the air intake portion 40 and shields the uppermost rotary blade group when the air intake portion 40 is viewed from the chamber 11 side.

As shown in FIG. 7A, the shielding unit 63 is comprised of a disk-shaped filter 64. The filter 64 is comprised of the particle capturing material described in detail in the above description of the first embodiment and is constructed as a particle capturing mechanism that captures particles.

According to the present embodiment, in the air intake portion 40 of the TMP 62, the shielding unit 63 is disposed which shields the uppermost rotary blade group when the air intake portion 40 is viewed from the chamber 11 side, that is, the uppermost rotary blade group cannot be seen when the air intake portion 40 is viewed from every possible angle on the chamber 11 side, and hence the same effects as those in the first embodiment described above can be obtained.

Next, a description will be given of a substrate processing apparatus to which a communicating pipe according to a seventh embodiment of the present invention is applied. It should be noted that the substrate processing apparatus to which the communicating pipe according to the present embodiment is applied is basically the same as the substrate processing apparatus to which the exhaust pump according to the first embodiment described above is applied in terms of construction and operation, differing from the first embodiment in the construction of the communicating pipe. Features of the construction and operation that are the same as in the first embodiment will thus not be described, only features that are different from those of the first embodiment being described below.

Figure 8:
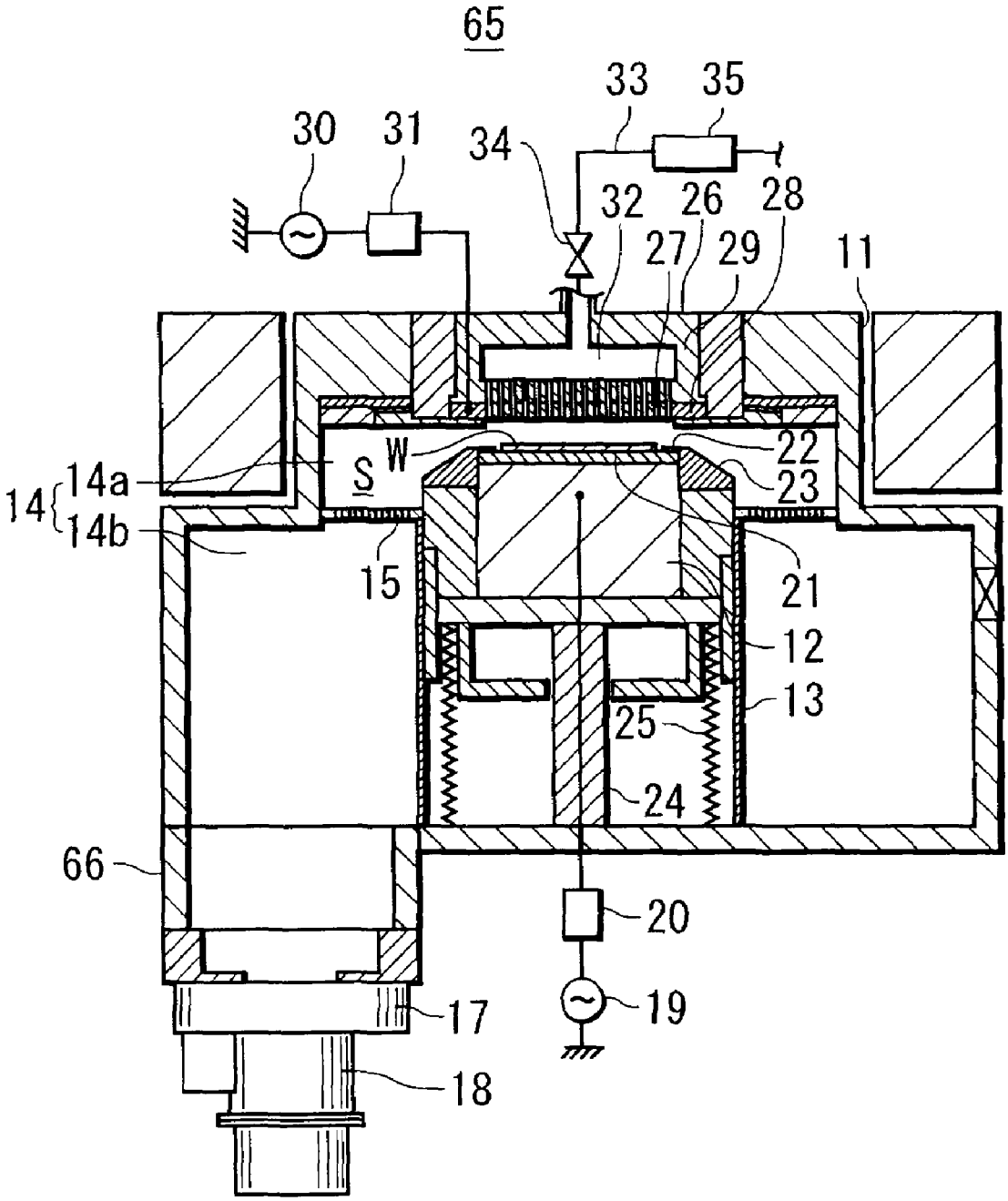
FIG. 8 is a sectional view schematically showing the construction of a substrate processing apparatus to which a communicating pipe according to a seventh embodiment of the present invention is applied.

FIG. 8 is a sectional view schematically showing the construction of the substrate processing apparatus to which the communicating pipe according to the seventh embodiment is applied.

As shown in FIG. 8, the substrate processing apparatus 65 has an exhaust manifold 66 that linearly communicates the downstream side portion 14*b* and the TMP 18 together via the APC valve 17. A shielding unit 67, described later, is disposed inside the exhaust manifold 66.

Figure 9A:
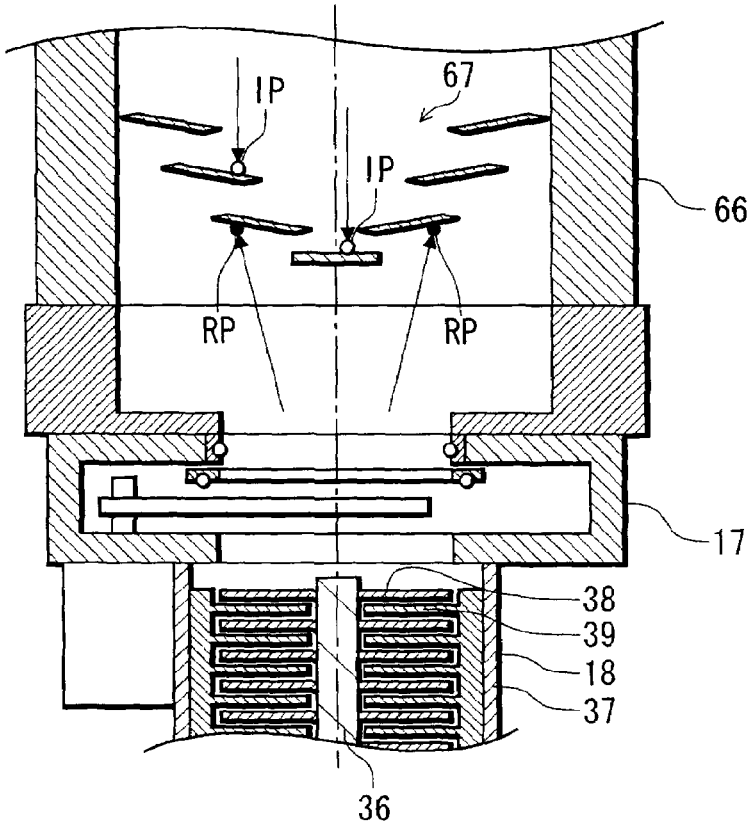

FIG. 9A is a sectional view showing how the shielding unit is disposed in the exhaust manifold shown in FIG. 8.

As shown in FIG. 9A, the exhaust manifold 66 has a shielding unit 67 that shields the uppermost rotary blade group in the TMP 18 when the exhaust manifold 66 is viewed from the chamber 11 side.

The shielding unit 67 is basically the same as the above described shielding unit 41 shown in FIG. 2A in terms of construction and operation, and therefore description thereof is omitted.

The interior of the exhaust manifold 66 is in an environment at a low pressure of at least not more than 26. 6 Pa (200 mTorr), and hence in the exhaust manifold 66, particles IP that have been exhausted from the chamber 11 and entered the exhaust manifold 66 and particles RP that have entered the exhaust manifold 66 through kinetic energy given by the rotary blades 38 linearly move in a fixed direction.

In the present embodiment, the particles IP that have been exhausted from the chamber 11 and entered the exhaust manifold 66 move in a vertical direction as viewed in FIG. 9A, that is, along an exhaust stream. In the exhaust manifold 66, the shielding unit 67 is disposed which shields the uppermost rotary blade group when the exhaust manifold 66 is viewed from the chamber 11 side, that is, the uppermost rotary blade group cannot be seen when the exhaust manifold 66 is viewed from every possible angle on the chamber 11 side, and hence the particles IP collide with the shielding unit 67 in the exhaust manifold 66. Members constituting the shielding unit 67 are comprised of a particle capturing mechanism or a kinetic energy decreasing mechanism. Thus, the particles IP are captured by the shielding unit 67 in the exhaust manifold 66. The particles RP that have been produced by exfoliation of deposit attached to the rotary blades 38 of the TMP 18 and entered the exhaust manifold 66 through kinetic energy given by the rotary blades 38 linearly move upward as shown in FIG. 9A. Thus, the particles RP are also captured by the shielding unit 67 in the exhaust manifold 66.

According to the present embodiment, in the exhaust manifold 66, the shielding unit 67 is disposed which shields the uppermost rotary blade group when the exhaust manifold 66 is viewed from the chamber 11 side, that is, the uppermost rotary blade group cannot be seen when the exhaust manifold 66 is viewed from every possible angle on the chamber 11 side, and hence the particles IP that have been exhausted from the chamber 11 and entered the exhaust manifold 66 are captured by the shielding unit 67 in the exhaust manifold 66. As a result, the particles IP can be prevented from reaching the rotary blades 38 of the TMP 18, and hence the particles IP can be prevented from colliding with the rotary blades 38 and recoiling to directly flow back into the chamber 11. Further, the particles RP that have been produced by exfoliation of deposit attached to the rotary blades 38 of the TMP 18 and entered the exhaust manifold 66 through kinetic energy given by the rotary blades 38 are also captured by the shielding unit 67 in the exhaust manifold 66. As a result, the particles can be prevented from flowing back into the chamber 11. Thus, the particles can be prevented from entering the chamber 11.

Moreover, according to the present embodiment, because the shielding unit 67 can be easily detached from the exhaust manifold 66, the cleanness of the interior of the exhaust manifold 66 can be easily improved by cleaning the shielding unit 67, and hence the frequency with which the exhaust manifold 66 should be cleaned can be decreased.

Next, a description will be given of a communicating pipe according to an eighth embodiment of the present invention.

The present embodiment is basically the same as the seventh embodiment described above in terms of construction and operation, differing from the seventh embodiment in the construction of the shielding unit. Features of the construction and operation that are the same as in the seventh embodiment will thus not be described, only features that are different from those of the seventh embodiment being described below. Also, a substrate processing apparatus to which the communicating pipe according to the present embodiment is applied is basically the same as the substrate processing apparatus to which the communicating according to the seventh embodiment described above is applied in terms of construction and operation, and therefore description thereof is omitted.

Figure 9B:
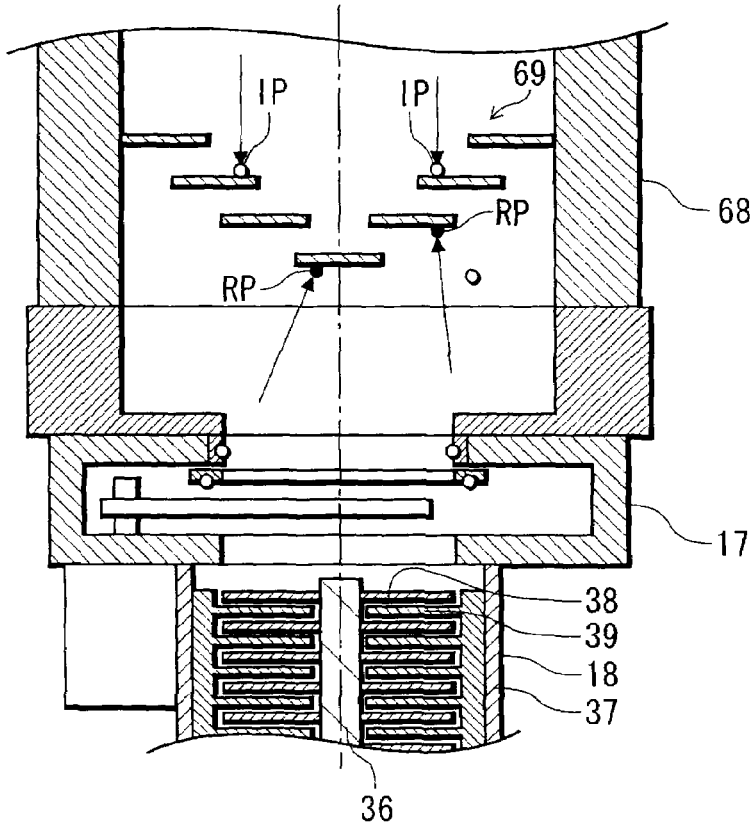

FIG. 9B is a sectional view showing how a shielding unit is disposed in an exhaust manifold as the communicating pipe according to the eighth embodiment.

As shown in FIG. 9B, the exhaust manifold 68 has a shielding unit 69 that shields the uppermost rotary blade group in the TMP 18 when the exhaust manifold 68 is viewed from the chamber 11 side.

The shielding unit 69 is basically the same as the above described shielding unit 46 shown in FIG. 3A in terms of construction and operation, and therefore description thereof is omitted.

According to the present embodiment, in the exhaust manifold 68, the shielding unit 69 is disposed which shields the uppermost rotary blade group when the exhaust manifold 68 is viewed from the chamber 11 side, that is, the uppermost rotary blade group cannot be seen when the exhaust manifold 68 is viewed from every possible angle on the chamber 11 side, and hence the same effects as those in the seventh embodiment described above can be obtained.

Next, a description will be given of a communicating pipe according to a ninth embodiment of the present invention.

The present embodiment is basically the same as the seventh and eighth embodiments described above in terms of construction and operation, differing from the seventh and eighth embodiments in the construction of the shielding unit. Features of the construction and operation that are the same as in the seventh and eighth embodiments will thus not be described, only features that are different from those of the seventh and eighth embodiments being described below.

Figure 10A:
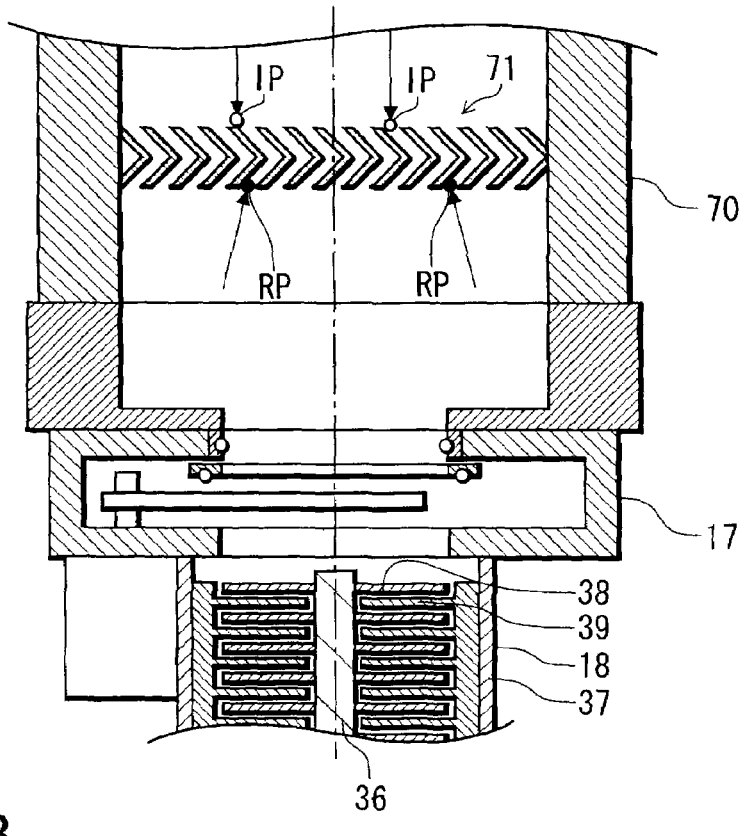

FIG. 10A is a sectional view showing how a shielding unit is disposed in an exhaust manifold as the communicating pipe according to the ninth embodiment.

As shown in FIG. 10A, the exhaust manifold 70 has a shielding unit 71 that shields the uppermost rotary blade group in the TMP 18 when the exhaust manifold 70 is viewed from the chamber 11 side.

The shielding unit 71 is basically the same as the above described shielding unit 50 shown in FIG. 4A in terms of construction and operation, and therefore description thereof is omitted.

According to the present embodiment, in the exhaust manifold 70, the shielding unit 71 is disposed which shields the uppermost rotary blade group when the exhaust manifold 70 is viewed from the chamber 11 side, that is, the uppermost rotary blade group cannot be seen when the exhaust manifold 70 is viewed from every possible angle on the chamber 11 side, and hence the same effects as those in the seventh embodiment described above can be obtained.

Next, a description will be given of a communicating pipe according to a tenth embodiment of the present invention.

The present embodiment is basically the same as the seventh to ninth embodiments described above in terms of construction and operation, differing from the seventh to ninth embodiments in the construction of the shielding unit. Features of the construction and operation that are the same as in the seventh to ninth embodiments will thus not be described, only features that are different from those of the seventh to ninth embodiments being described below.

Figure 10B:
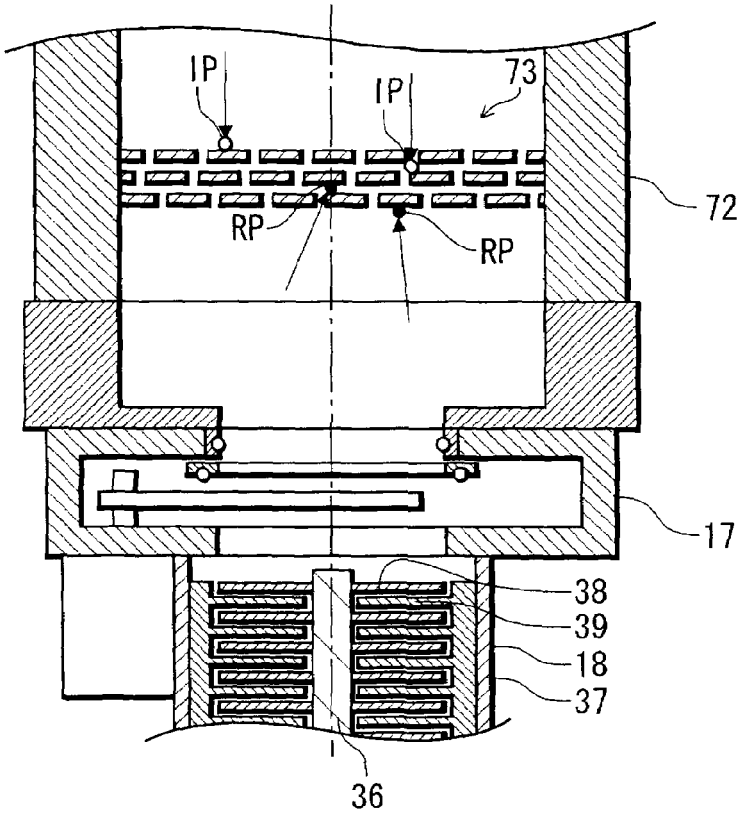

FIG. 10B is a sectional view showing how a shielding unit is disposed in an exhaust manifold as the communicating pipe according to the tenth embodiment.

As shown in FIG. 10B, the exhaust manifold 72 has a shielding unit 73 that shields the uppermost rotary blade group in the TMP 18 when the exhaust manifold 72 is viewed from the chamber 11 side.

The shielding unit 73 is basically the same as the above described shielding unit 53 shown in FIG. 5A in terms of construction and operation, and therefore description thereof is omitted.

According to the present embodiment, in the exhaust manifold 72, the shielding unit 73 is disposed which shields the uppermost rotary blade group when the exhaust manifold 72 is viewed from the chamber 11 side, that is, the uppermost rotary blade group cannot be seen when the exhaust manifold 72 is viewed from every possible angle on the chamber 11 side, and hence the same effects as those in the seventh embodiment described above can be obtained.

Next, a description will be given of a communicating pipe according to an eleventh embodiment of the present invention.

The present embodiment is basically the same as the seventh to tenth embodiments described above in terms of construction and operation, differing from the seventh to tenth embodiments in the construction of the shielding unit. Features of the construction and operation that are the same as in the seventh to tenth embodiments will thus not be described, only features that are different from those of the seventh to tenth embodiments being described below.

Figure 11A:
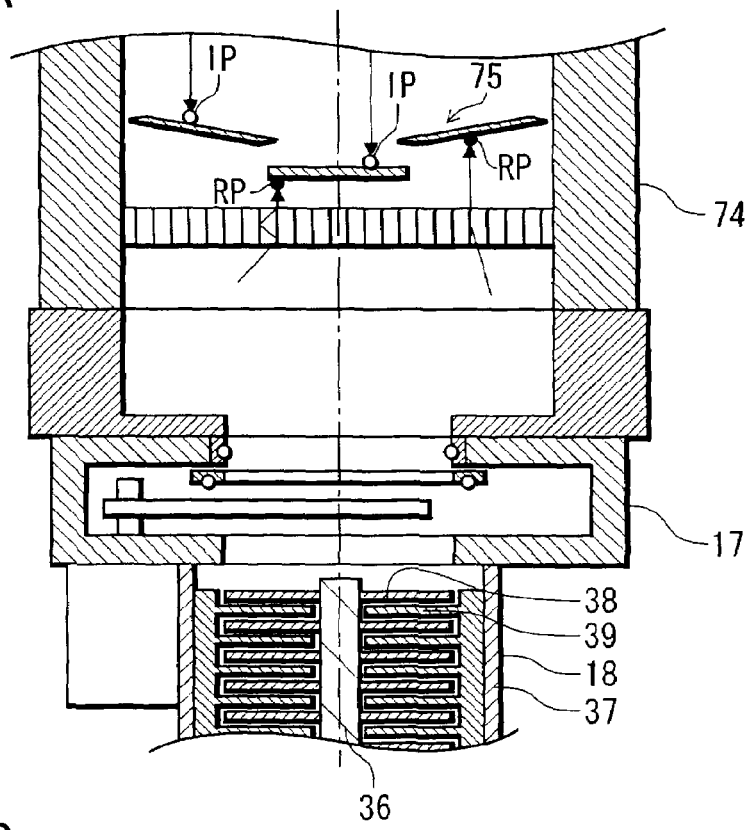

FIG. 11A is a sectional view showing how a shielding unit is disposed in an exhaust manifold as the communicating pipe according to the eleventh embodiment.

As shown in FIG. 11A, the exhaust manifold 74 has a shielding unit 75 that shields the uppermost rotary blade group in the TMP 18 when the exhaust manifold 74 is viewed from the chamber 11 side.

The shielding unit 75 is basically the same as the above described shielding unit 57 shown in FIG. 6A in terms of construction and operation, and therefore description thereof is omitted.

According to the present embodiment, in the exhaust manifold 74, the shielding unit 75 is disposed which shields the uppermost rotary blade group when the exhaust manifold 74 is viewed from the chamber 11 side, that is, the uppermost rotary blade group cannot be seen when the exhaust manifold 74 is viewed from every possible angle on the chamber 11 side, and hence the same effects as those in the seventh embodiment described above can be obtained.

Next, a description will be given of a communicating pipe according to a twelfth embodiment of the present invention.

The present embodiment is basically the same as the seventh to eleventh embodiments described above in terms of construction and operation, differing from the seventh to eleventh embodiments in the construction of the shielding unit. Features of the construction and operation that are the same as in the seventh to eleventh embodiments will thus not be described, only features that are different from those of the seventh to eleventh embodiments being described below.

Figure 11B:
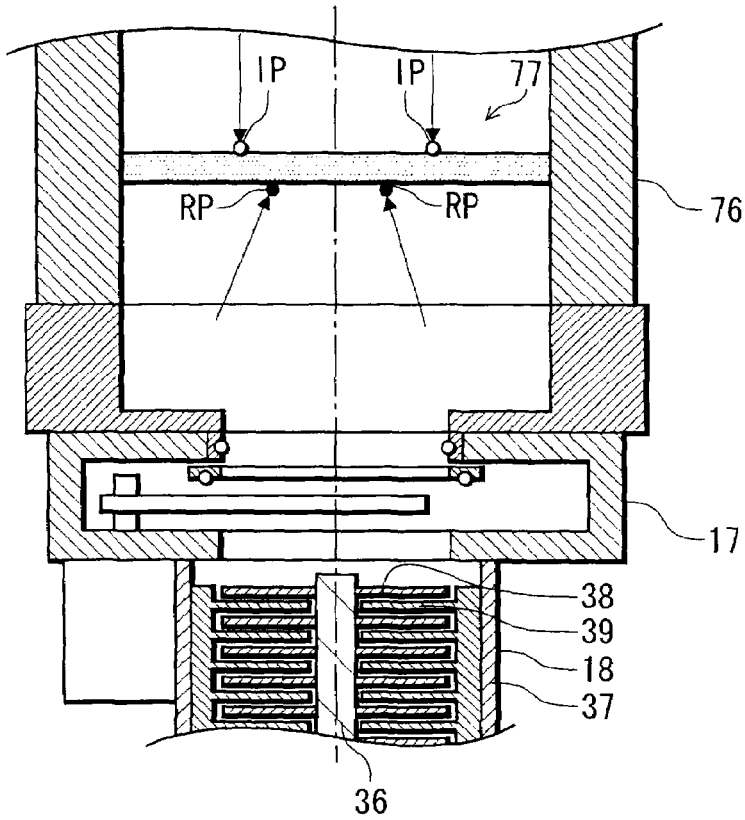

FIG. 11B is a sectional view showing how a shielding unit is disposed in an exhaust manifold as the communicating pipe according to the twelfth embodiment.

As shown in FIG. 11B, the exhaust manifold 76 has a shielding unit 77 that shields the uppermost rotary blade group in the TMP 18 when the exhaust manifold 76 is viewed from the chamber 11 side.

The shielding unit 77 is basically the same as the above described shielding unit 63 shown in FIG. 7A in terms of construction and operation, and therefore description thereof is omitted.

According to the present embodiment, in the exhaust manifold 76, the shielding unit 77 is disposed which shields the uppermost rotary blade group when the exhaust manifold 76 is viewed from the chamber 11 side, that is, the uppermost rotary blade group cannot be seen when the exhaust manifold 76 is viewed from every possible angle on the chamber 11 side, and hence the same effects as those in the seventh embodiment described above can be obtained.

Although in the above described embodiments, the exhaust pumps and the communicating pipes are separately applied to the substrate processing apparatus, the exhaust pumps and the communicating pipes may be applied in arbitrary combinations to the substrate processing apparatus.

In the above described embodiments, the substrate processing apparatus is an etching processing apparatus as a semiconductor device manufacturing apparatus, the apparatus to which the present invention may be applied is not limited to this, but may be another semiconductor device manufacturing apparatus using plasma, such as a deposition apparatus using CVD (chemical vapor deposition) or PVD (physical vapor deposition). Further, the present invention may be applied to an etching apparatus such as an ion implantation processing apparatus, a vacuum transfer apparatus, a thermal treatment apparatus, an analyzing apparatus, an electron accelerator, an FPD (flat panel display) manufacturing apparatus, a solar cell manufacturing apparatus, an etching processing apparatus as a physical quantity analyzing apparatus, or an evacuation processing apparatus using a TMP such as a deposition processing apparatus.

Further, the substrates subjected to the predetermined processing according to the above described embodiments are not limited to being semiconductor wafers, but rather may instead be any of various glass substrates used in LCDs (Liquid Crystal Displays), FPDs (Flat Panel Displays) or the like.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2007-0085430 filed Mar. 28, 2007, which is hereby incorporated by reference herein in its entirety.

What is claimed is:

1. An exhaust pump that is connected to a processing chamber of a substrate processing apparatus and has rotary blades and an air intake portion disposed on the processing chamber side of the rotary blades, comprising:

a shielding unit that is fixed inside the air intake portion and is disposed so as to shield the rotary blades when the air intake portion is viewed from the processing chamber side, wherein said shielding unit comprises a plurality of funnel-shaped members and a plate-shaped member disposed on the rotary blade side of said plurality of funnel-shaped members, and each of said plurality of funnel-shaped members has in a bottom portion thereof an opening facing said plate-shaped member, and the closer the openings of said plurality of funnel-shaped members are to said plate-shaped member, the smaller the openings of said plurality of funnel-shaped members.

2. An exhaust pump as claimed in claim 1, wherein each of said funnel-shaped members and said plate-shaped member comprises a particle capturing member that captures particles or a kinetic energy decreasing member that decreases kinetic energy of particles.

3. An exhaust pump as claimed in claim 2, wherein the particle capturing member and/or the kinetic energy decreasing member are/is comprised of at least one of a particle capturing material, a shock absorbing material, an adhesive material, and a particle introducing structure.

4. An exhaust pump as claimed in claim 3, wherein the particle capturing material, the shock absorbing material, the adhesive material, and the particle introducing structure are heat-resistant, resistant to corrosion by plasma, acid-resistant, and have stiffness against an exhaust stream, including metal, ceramics, quartz, organic compound, and a predetermined core material subjected to surface treatment such as oxidation or thermal spraying.

5. An exhaust pump that is connected to a processing chamber of a substrate processing apparatus and has rotary blades and an air intake portion disposed on the processing chamber side of the rotary blades, comprising:

a shielding unit that is fixed inside the air intake portion and is disposed so as to shield the rotary blades when the air intake portion is viewed from the processing chamber side, wherein said shielding unit comprises a laminated structure in which a plurality of plate-shaped members are arranged side by side and disposed away from each other, and each of the plate-shaped members comprises a plurality of holes that face the rotary blades and each of the holes of one of the plate-shaped members is disposed non-collinearly with each of the holes of the other plate-shaped members.

6. An exhaust pump as claimed in claim 5, wherein each of the plate-shaped members comprises a particle capturing member that captures particles or a kinetic energy decreasing member that decreases kinetic energy of particles.

7. An exhaust pump as claimed in claim 6, wherein the particle capturing member and/or the kinetic energy decreasing member are/is comprises of at least one of a particle capturing material, a shock absorbing material, an adhesive material, and a particle introducing structure.

8. An exhaust pump as claimed in claim 7, wherein the particle capturing material, the shock absorbing material, the adhesive material, and the particle introducing structure are heat-resistant, resistant to corrosion by plasma, acid-resistant, and have stiffness against an exhaust stream, including metal, ceramics, quartz, organic compound, and a predetermined core material subjected to surface treatment such as oxidation or thermal spraying.

9. An exhaust pump that is connected to a processing chamber of a substrate processing apparatus and has rotary blades and an air intake portion disposed on the processing chamber side of the rotary blades, comprising:

a shielding unit that is fixed inside the air intake portion and is disposed so as to shield the rotary blades when the air intake portion is viewed from the processing chamber side, wherein said shielding unit comprises a funnel-shaped member, a plate-shaped member disposed on the rotary blade side of said funnel-shaped member, and a baffle device comprising a plurality of cylindrical members that are disposed parallel to each other and arranged side by side, and said funnel-shaped member has in a bottom portion thereof an opening that faces said plate-shaped member.

10. An exhaust pump as claimed in claim 9, wherein each of said funnel-shaped member, said plate-shaped member, and said cylindrical members comprises a particle capturing member that captures particles or a kinetic energy decreasing member that decreases kinetic energy of particles.

11. An exhaust pump as claimed in claim 10, wherein the particle capturing member and/or the kinetic energy decreasing member are/is comprised of at least one of a particle capturing material, a shock absorbing material, an adhesive material, and a particle introducing structure.

12. An exhaust pump as claimed in claim 11, wherein the particle capturing material, the shock absorbing material, the adhesive material, and the particle introducing structure are heat-resistant, resistant to corrosion by plasma, acid-resistant, and have stiffness against an exhaust stream, including metal, ceramics, quartz, organic compound, and a predetermined core material subjected to surface treatment such as oxidation or thermal spraying.

13. A communicating pipe that communicates a processing chamber of a substrate processing apparatus and an exhaust pump having rotary blades together, comprising:

a shielding unit that is fixed inside the communicating pipe and is disposed so as to shield the rotary blades when the communicating pipe is viewed from the processing chamber side, wherein said shielding unit comprises a plurality of funnel-shaped members and a plate-shaped member disposed on the rotary blade side of said plurality of funnel-shaped members, and each of said plurality of funnel-shaped members has in a bottom portion thereof an opening that faces said plate-shaped member, and the closer the openings of said plurality of funnel-shaped members are to said plate-shaped member, the smaller the openings of said plurality of funnel-shaped members.

14. A communicating pipe that communicates a processing chamber of a substrate processing apparatus and an exhaust pump having rotary blades together, comprising:

a shielding unit that is fixed inside the communicating pipe and is disposed so as to shield the rotary blades when the communicating pipe is viewed from the processing chamber side, wherein said shielding unit comprises a laminated structure in which a plurality of plate-shaped members are arranged side by side and disposed away from each other, and each of the plate-shaped members comprises a plurality of holes that face the rotary blades and each of the holes of one of the plate-shaped members is disposed non-collinearly with each of the holes of the other plate-shaped members.

15. A communicating pipe that communicates a processing chamber of a substrate processing apparatus and an exhaust pump having rotary blades together, comprising:

a shielding unit that is fixed inside the communicating pipe and is disposed so as to shield the rotary blades when the communicating pipe is viewed from the processing chamber side, wherein said shielding unit comprises a funnel-shaped member, a plate-shaped member disposed on the rotary blade side of said funnel-shaped member, and a baffle device comprising a plurality of cylindrical members that are disposed parallel to each other and arranged side by side, and said funnel-shaped member has in a bottom portion thereof an opening that faces said plate-shaped member.

* * * * *